US012310476B2

(12) United States Patent
Karl et al.

(10) Patent No.: US 12,310,476 B2
(45) Date of Patent: May 27, 2025

(54) LUGGAGE ARTICLE ATTACHMENT MEMBER

(71) Applicant: Samsonite IP Holdings S.a r.l., Luxembourg (LU)

(72) Inventors: Philip Justin Karl, Rehoboth, MA (US); Ulliyada Bopanna, Milton, MA (US)

(73) Assignee: Samsonite IP Holdings S.a r.l., Luxembourg (LU)

( * ) Notice: Subject to any disclaimer, the term of this patent is extended or adjusted under 35 U.S.C. 154(b) by 154 days.

(21) Appl. No.: 18/077,150

(22) Filed: Dec. 7, 2022

(65) Prior Publication Data

US 2023/0098364 A1 Mar. 30, 2023

Related U.S. Application Data

(63) Continuation-in-part of application No. 17/546,167, filed on Dec. 9, 2021.
(Continued)

(51) Int. Cl.
*A45C 13/38* (2006.01)
*A45C 5/03* (2006.01)

(52) U.S. Cl.
CPC ..... *A45C 13/38* (2013.01); *A45C 5/03* (2013.01); *A45C 2005/037* (2013.01)

(58) Field of Classification Search
CPC ..... A45C 13/38; A45C 5/03; A45C 2005/037; A45C 13/001
See application file for complete search history.

(56) References Cited

U.S. PATENT DOCUMENTS 4,550,813 A 11/1985 Browning
4,759,431 A 7/1988 King et al.
(Continued)

FOREIGN PATENT DOCUMENTS

CN 2239741 Y 11/1996
CN 2290223 Y 9/1998
(Continued)

OTHER PUBLICATIONS

Extended European Search Report for European Patent Application No. 23214873.4 dated Apr. 18, 2024, 8 pages.

*Primary Examiner* — Don M Anderson
*Assistant Examiner* — Justin Caudill
(74) *Attorney, Agent, or Firm* — Dorsey & Whitney LLP

(57) ABSTRACT

A luggage article (400, 700) having an attachment member (501, 801) for releasably supporting a second article (401, 701), the luggage article (400, 700) including a first shell (418, 718) and a second shell (420, 720) selectively secured together along a line of connection (426, 726) by a closure mechanism (424, 724), a lock mechanism (600, 900) to selectively engage and disengage the closure mechanism (424, 724), an attachment member (501, 801) including a base plate (505, 805) and a retention feature (520, 820) extending away from the base plate (505, 805), the attachment member (501, 801) attached together with the lock mechanism (600, 900) to a panel (403, 703) of one of the first (418, 718) or second shells (420, 720), and a gap (554, 854) is formed between at least a portion of the retention feature (520, 820) and the panel (403, 703), and the retention feature (520, 820) is deflected away from and biased back towards the panel (403, 703) to capture the second article (401, 701).

20 Claims, 15 Drawing Sheets

Related U.S. Application Data

(60) Provisional application No. 63/182,580, filed on Apr. 30, 2021.

(56) References Cited

U.S. PATENT DOCUMENTS

| | | | | |
|---|---|---|---|---|
| 4,817,769 | A * | 4/1989 | Saliba | A45C 3/02 190/18 R |
| 4,993,526 | A | 2/1991 | Morrison | |
| 5,311,972 | A | 5/1994 | Plath | |
| 5,501,308 | A | 3/1996 | King | |
| 5,762,169 | A | 6/1998 | Deliman et al. | |
| 5,842,673 | A | 12/1998 | Fenton | |
| 6,141,841 | A | 11/2000 | Workman | |
| 6,213,266 | B1 | 4/2001 | Hollingsworth | |
| 6,216,322 | B1 | 4/2001 | Kuo | |
| 6,347,693 | B1 | 2/2002 | Chen | |
| 6,640,400 | B1 | 11/2003 | Chen | |
| 7,559,115 | B2 | 7/2009 | Tong et al. | |
| D777,437 | S * | 1/2017 | Stone | D3/318 |
| 9,638,572 | B2 | 5/2017 | Moon | |
| 10,349,717 | B2 | 7/2019 | Hamzaee et al. | |
| 10,631,607 | B2 | 4/2020 | Yu | |
| 2003/0042090 | A1 | 3/2003 | Wang | |
| 2003/0066170 | A1 * | 4/2003 | Huang | A44B 19/301 24/387 |
| 2004/0084269 | A1 | 5/2004 | Wang | |
| 2004/0211634 | A1 | 10/2004 | Chan | |
| 2006/0102677 | A1 * | 5/2006 | Nassanian | A45C 13/02 224/652 |
| 2010/0307878 | A1 * | 12/2010 | Giglio | A45C 7/0086 190/100 |
| 2015/0034440 | A1 * | 2/2015 | Lai | A45C 7/0027 190/103 |
| 2015/0040622 | A1 * | 2/2015 | Meersschaert | A45C 13/10 70/69 |
| 2018/0279730 | A1 * | 10/2018 | Yu | A45C 5/14 |
| 2019/0373997 | A1 * | 12/2019 | Lee | A45C 13/103 |
| 2022/0346514 | A1 | 11/2022 | Karl et al. | |
| 2023/0098874 | A1 | 3/2023 | Karl et al. | |

FOREIGN PATENT DOCUMENTS

| | | | |
|---|---|---|---|
| CN | 2484794 | Y | 4/2002 |
| CN | 206866804 | U | 1/2018 |
| CN | 108669742 | A | 10/2018 |
| CN | 108884853 | A | 11/2018 |
| CN | 110621189 | B | 7/2021 |
| DE | 4221215 | A1 | 1/1994 |
| DE | 9419014 | U1 | 2/1995 |
| DE | 102006055463 | B4 | 5/2018 |
| EP | 3170421 | A1 | 5/2017 |
| EP | 3354154 | A1 | 8/2018 |
| EP | 4381988 | A1 | 6/2024 |
| FR | 2789856 | A1 | 8/2000 |
| JP | 3172052 | U | 11/2011 |
| JP | 3181838 | U | 1/2013 |
| JP | 2018158131 | A * | 10/2018 |
| WO | 9519119 | A1 | 7/1995 |
| WO | 9639891 | A1 | 12/1996 |

* cited by examiner

FIG. 9A
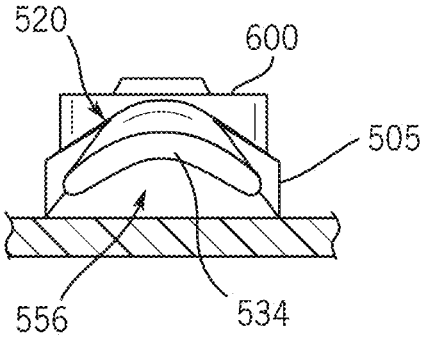
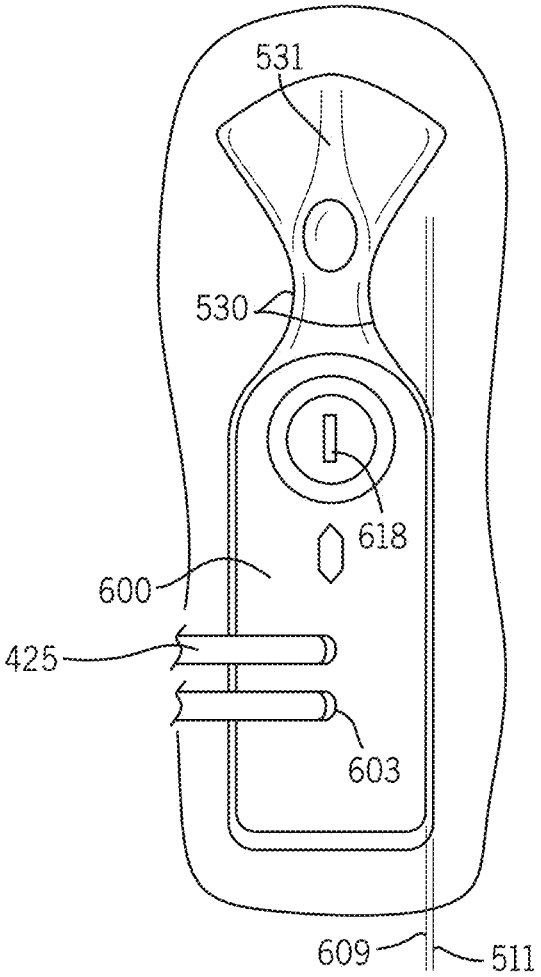
FIG. 9B

LUGGAGE ARTICLE ATTACHMENT MEMBER

CROSS-REFERENCE TO RELATED APPLICATIONS

This application is a continuation-in-part application of U.S. patent application Ser. No. 17/546,167, filed 9 Dec. 2021, entitled "Luggage Article Attachment Member," which claims the benefit of priority pursuant to 35 U.S.C. § 119 (e) of U.S. provisional patent application No. 63/182,580, filed 30 Apr. 2021, entitled "Luggage Article Attachment Member;" both of which are hereby incorporated by reference herein in their entirety for all purposes. The application is related to U.S. patent application Ser. No. 18/077,146, filed 7 Dec. 2022, entitled "Luggage Article Attachment Member," which is also a continuation-in-part application of U.S. patent application Ser. No. 17/546,167, filed 9 Dec. 2021, entitled "Luggage Article Attachment Member," which claims the benefit of priority pursuant to 35 U.S.C. § 119 (e) of U.S. provisional patent application No. 63/182,580, filed 30 Apr. 2021, entitled "Luggage Article Attachment Member."

BACKGROUND

Travelers frequently travel with many pieces of luggage. Moving with more than one luggage article can be cumbersome. For example when a traveler, especially a lone traveler, has more than one luggage article, the multiple pieces of luggage can be difficult to maneuver through an airport, train or bus station, or on a street. Many current luggage articles lack a feature by which a second luggage article can be selectively attached to a first luggage article to ease such travel burdens. Some current luggage articles include features such as belts or straps, which may be removable or retractable, by which a second luggage article may be selectively attached to a first luggage article. Such solutions are lacking in that they add un-necessary weight, complexity, and/or cost to the luggage article. Furthermore, removable attachment features are prone to being lost or misplaced. Features to enable the selective attachment of a second article to a luggage article, other than retractable attachment features, have not often been added to hard side luggage articles mainly due to the difficulty and expense of adding external features to hard side shell structures.

SUMMARY

The present disclosure provides a luggage article. In one embodiment, the luggage article includes an attachment member for releasably supporting a second article. The luggage article further includes a first shell and a second shell selectively secured together along a line of connection by a closure mechanism, a lock mechanism to selectively engage and disengage the closure mechanism, an attachment member including a base plate and a retention feature extending away from the base plate, the attachment member attached together with the lock mechanism to a panel of one of the first or second shells, a gap formed between at least a portion of the retention feature and the panel; and wherein the retention feature is deflected away from and biased back towards the panel to capture the second article.

Optionally, in some embodiments, the base plate may be positioned between the lock mechanism and the panel.

Optionally, in some embodiments, the lock mechanism and the attachment member may be secured to the panel from an inside region of the one of the first or second shells.

Optionally, in some embodiments, the lock mechanism may have an elongated shape defining a first longitudinal axis, the attachment member may have an elongated shape defining a second longitudinal axis, and the lock mechanism and attachment member may be oriented with the respective first and second axes extending along a length of the line of connection.

Optionally, in some embodiments, the lock mechanism and attachment member may be mounted near the line of connection.

Optionally, in some embodiments, the lock mechanism and attachment member may be mounted on a side panel.

Optionally, in some embodiments, the retention feature may include a free end directed downwardly toward the panel.

Optionally, in some embodiments, the free end may be spaced away from the panel

Optionally, in some embodiments, the free end may contact the panel.

Optionally, in some embodiments, the free end may define an opening feature.

Optionally, in some embodiments, the opening feature may define a cam surface to deflect the retention feature away from the panel as the second article is captured by the retention feature.

Optionally, in some embodiments, the gap may be greatest at a middle portion of the length of the retention feature Optionally, in some embodiments, the retention feature may have a concave shape facing the panel.

Optionally, in some embodiments, the retention feature may define a rectilinear shape.

Optionally, in some embodiments, the opening feature may include a ridge formed along a length of the retention feature.

Optionally, in some embodiments, the ridge may be formed by opposing edges of the retention feature being angled towards the panel.

Optionally, in some embodiments, the base plate may define a recess and the lock mechanism may be received at least partially in the recess.

Optionally, in some embodiments, the recess may defined by a rim and the retention feature may extend from the rim.

Optionally, in some embodiments, the base plate may define a first peripheral edge and the lock mechanism may define a second peripheral edge, and wherein the second peripheral edge may be spaced within the first peripheral edge.

Optionally, in some embodiments, the panel may define a recess, and the attachment member and the lock mechanism may be positioned within the recess.

Optionally, in some embodiments, the retention feature may extend over the recess.

Optionally, in some embodiments, the recess may extend past the end of the retention feature.

Optionally, in some embodiments, the retention features may extend from the recess over a portion of the panel adjacent the recess.

Optionally, in some embodiments, the recess may be located adjacent the closure mechanism.

DRAWINGS

The description will be more fully understood with reference to the following figures in which components are not drawn to scale, which are presented as various examples of the present disclosure and should not be construed as a complete recitation of the scope of the disclosure, characterized in that:

FIG. 9A shows an end elevation view of the attachment member of FIG. 7.

FIG. 9B shows a top plan view of the attachment member of FIG. 7.

DETAILED DESCRIPTION

Referring to FIGS. 1-6, an attachment member 200 for a luggage article 100 according to an embodiment is disclosed. Another luggage article 101 may engage the attachment member 200 to be transported along with the luggage article 100. The luggage article 101 may be referred to as a second or auxiliary article 101. In some examples, the attachment member 200 may include a hook member portion 211 to which the other luggage article 101 or other object attaches.

Figure 1:
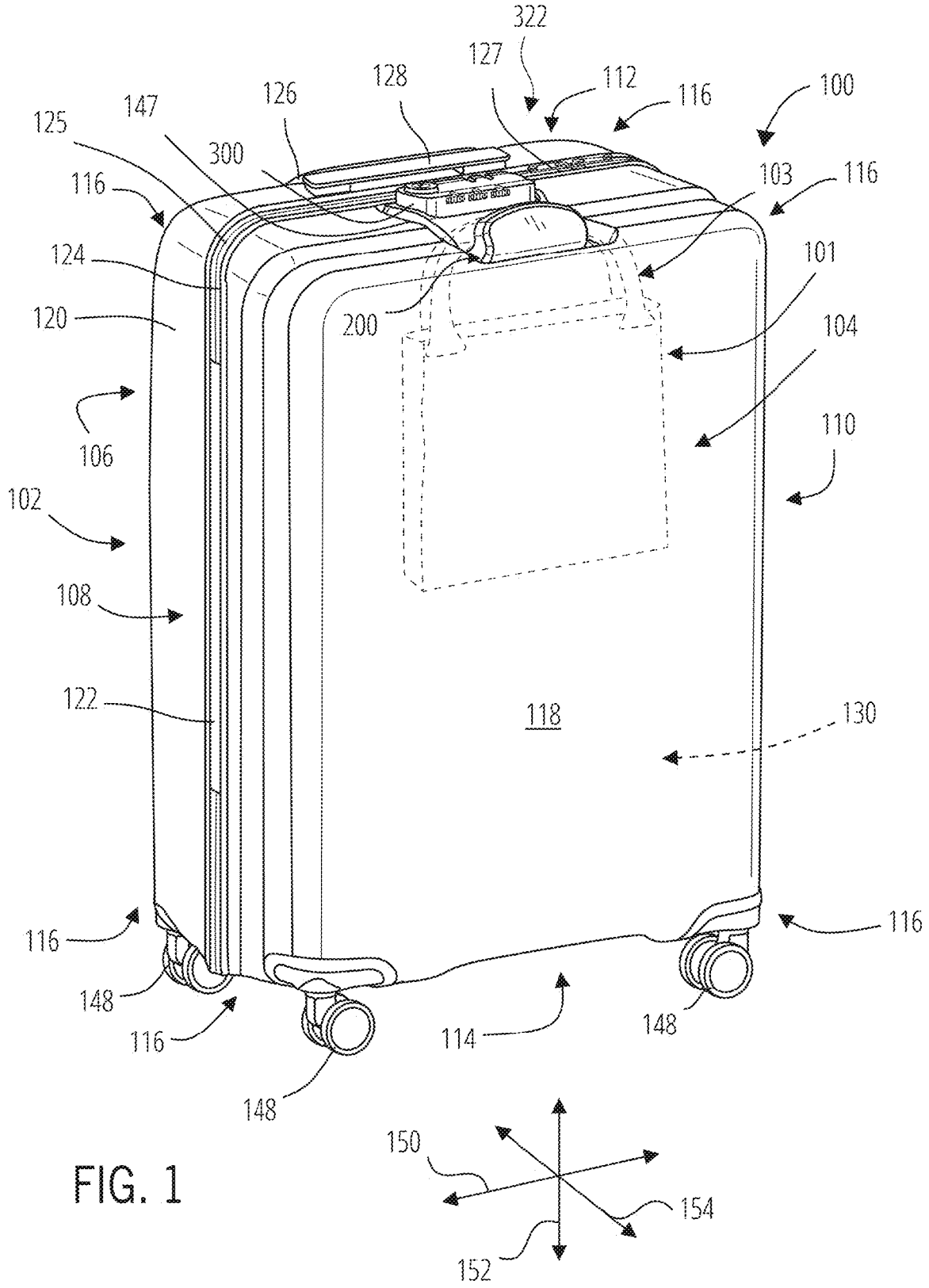
FIG. 1 is an isometric view of a luggage article with an attachment member.

FIG. 1 is an isometric view of a luggage article 100 in a closed configuration, which in some examples may be referred to as a luggage case 100. The luggage article 100 illustrated in FIG. 1 is an upright hard side case. The luggage article 100 has a main body 102 with a plurality of panels defining an internal storage volume 130 to carry a user's belongings. The luggage article 100 includes a front panel 104 and an opposing rear panel 106, top panel 112 and bottom panel 114, and opposing left panel 108 and right panel 110. Corner regions 116 may be defined by the intersection of any two or three adjacent panels. The luggage article 100 can be moved between a closed configuration in which a lid 118 and a base 120 of the main body 102 are positioned adjacent one another to selectively open or close to provide access to the internal storage volume 130. In some examples, the luggage article 100 may include one or more carry handles 128 and/or a retractable tow handle 126 extendable from a rear panel 106 of the luggage article 100. The luggage article 100 may include one or more foot elements 148 such as wheels, casters, spinner assemblies, posts, or the like to support or enable the movement of the luggage article 100 on a support surface such as a floor, street, sidewalk, or the ground. The luggage article 100 may be many types of luggage, including a soft side spinner case, a hybrid spinner case, a container, or the like.

Throughout this disclosure, reference may be made to a width or transverse direction 150, a length or vertical direction 152, and/or a depth direction 154. The width or transverse direction 150 is generally a direction between the left panel 108 and the right panel 110. The length or vertical direction 152 is generally a direction between the top panel 112 and the bottom panel 114. The depth direction 154 is generally a direction between the front panel 104 and rear panel 106. The width direction 150, length direction 152, and depth direction 154 may be mutually orthogonal in some examples. These directions are meant to be illustrative only and are in no way limiting.

Turning to FIG. 1, in one example, the luggage article 100 has a recess 132 formed in the main body 102. The luggage article 100 includes an attachment member 200 coupled to the main body 102, and in this example the attachment member 200 is received in the recess 132. The attachment member 200 may be positioned in the recess 132 and coupled to an outer surface of the main body 102 together with a lock mechanism 300. The attachment member 200 may have an overall hook-like shape. In many embodiments, the recess is formed in the lid or the base. In the example, shown in FIG. 1, the recess 132 is formed in the lid 118 and the attachment member 200 is coupled to the lid 118 in the recess 132. In other examples, the attachment member 200 may be coupled to another portion of the main body 102, may be positioned in a recess or not positioned in a recess. As shown in FIG. 1, a second, auxiliary, or other luggage article 101, for example a hand bag, engages the attachment member 200 to be suspended along a front panel 104 of the luggage article 100. The second luggage article 101 may include a portion to engage the attachment member 200, such as handles 103. One or more of the handles 103 are seated in and selectively engaged with the attachment member 200 (also see the representative dashed handles 103 in FIG. 5).

The luggage article 100 can be configured in an open position with the lid 118 and the base 120 positioned apart from one another. The lid 118 and the base 120 may be pivotably attached together such as by a hinge 122 or similar mechanism, and may be releasably attached together by a closure mechanism 124 to releasably secure the lid 118 and the base 120 together in the closed configuration. In some examples, the closure mechanism 124 is a zipper 125. The closure mechanism 124 may extend along one or more edges of the lid 118 and the base 120. The closure mechanism 124 may include complementary portions on each of the lid 118 and the base 120, where the complementary portions are selectively couplable or decouplable relative to one another. When the complementary portions of the closure mechanism 124 are coupled, the lid 118 and the base 120 form a closed internal storage volume 130. The closure mechanism 124 may include an actuator such as one or more pull tabs that enable a user to selectively couple or decouple the complementary portions of the closure mechanism 124. In the example of a zipper, the closure mechanism 124 may have one or more pull tab actuators 127 that are slidable along the length of the closure mechanism 124 to selectively couple or decouple the complementary portions of the closure mechanism 124.

The lock mechanism 300 may be operable to thwart, prevent, or discourage the unauthorized opening of the luggage article 100. For example, the lock mechanism 300 may be a zipper lock, and may be operative to receive and secure the pull tab actuators 127 (see FIG. 1) of the zipper 125 example of a closure mechanism 124 to prevent the actuators from being slid along the length of the closure mechanism 124 and thus prevent the opening of the closure mechanism 124. The lock mechanism 300 may, additionally include a key or combination lock 129 such that persons with the key or combination can remove the pull tab actuators from the lock mechanism 300 such as by pushing an actuator 318, which causes the lock mechanism 300 to release the pull tabs.

Figure 4:
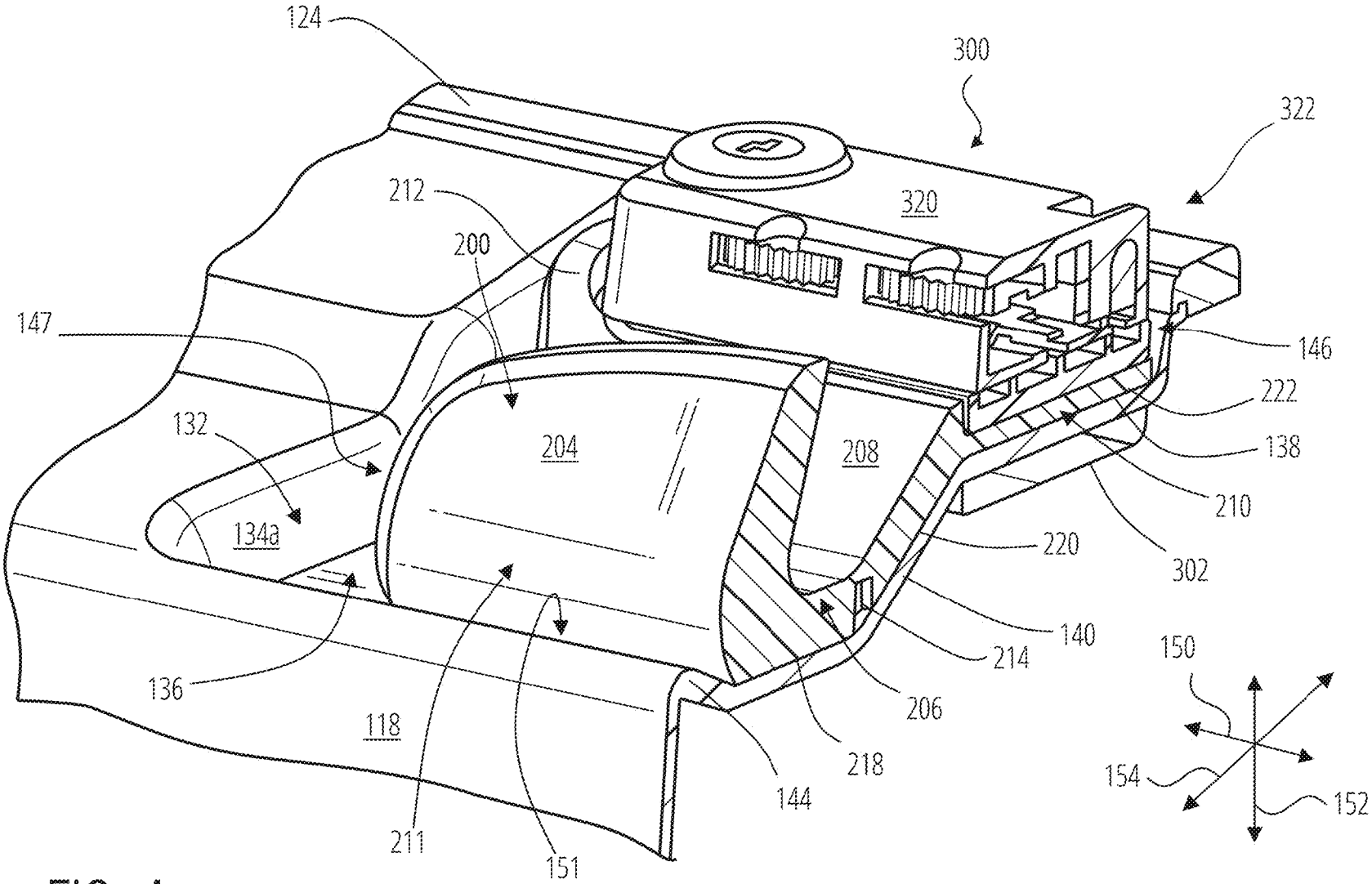
FIG. 4 is a partial section view of the luggage article of FIG. 1 taken along section line 4-4 of FIG. 2.
Figure 5:
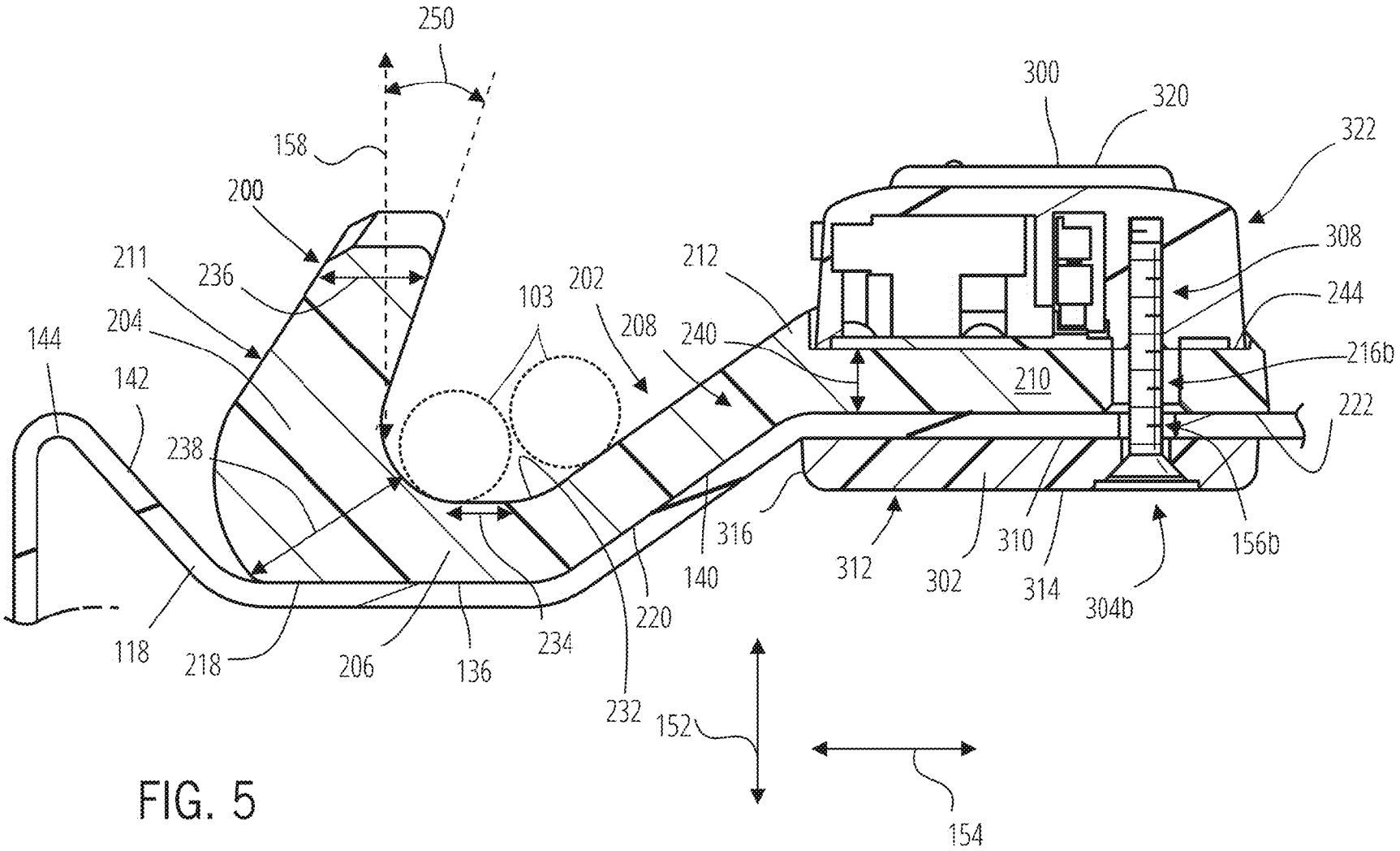
FIG. 5 is a partial section view of the luggage article of FIG. 1 taken along section line 5-5 of FIG. 2.
Figure 6:
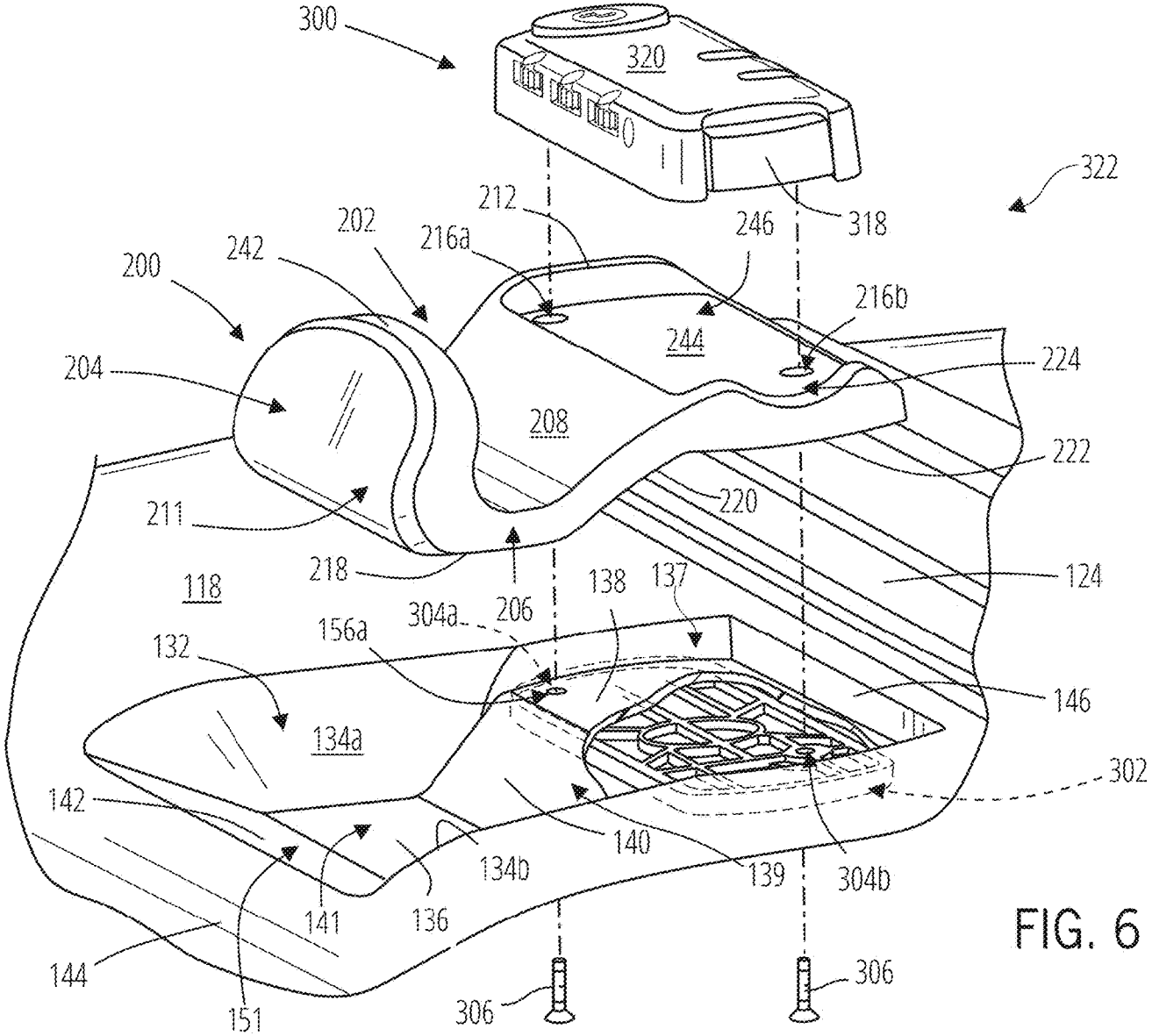
FIG. 6 is a partial exploded isometric view of the luggage article of FIG. 1.

In one embodiment, the lock mechanism 300 is secured to the main body 102 with an anchor element 302. The anchor element 302 is disposed inside the luggage article 100 and the lock mechanism 300 is disposed on the outside of the luggage article 100 with a portion of the main body 102 clamped between the anchor element 302 and the lock mechanism 300. The anchor element 302, in this example, includes a plate 312 with an upper face 310 and an opposing lower face 314. A wall 316 joins the upper face 310 and the lower face 314. The anchor element 302 may be formed of any suitable material such as plastic, metal, a composite material (e.g., a fiber reinforced composite), wood, etc. The anchor element 302 may have one or more apertures 304*a, b* formed therein. The apertures 304*a, b* may be adapted to receive one or more fasteners 306. As best shown in FIG. 4-FIG. 6, the anchor element 302 is disposed on an inner surface of the lid 118. In other embodiments, the anchor element 302 may be disposed on an inner surface of another portion of the main body 102, such as the base 120. As shown in FIG. 5, the lock mechanism 300 may include one or more recesses 308 formed therein that are operative to receive one or more fasteners 306. The recesses 308 and the fasteners 306 may be threaded to engage when the fastener 306 is rotated relative to the recess 308. Other types of fasteners 306 may be used, such as pins, nails, rivets, or the like. The recesses 308 may be blind recesses as shown, or they may be through holes that extend through the lock mechanism 300.

As best shown in FIG. 4-FIG. 6, in one embodiment, the attachment member 200 is coupled to the main body 102 together with the lock mechanism 300 as an assembly 322, positioned in this example on the outside of the main body 102. The anchor element 302 is disposed inside the luggage article 100. The attachment member 200 is disposed on the outside of the luggage article 100. The lock mechanism 300 is disposed on top of, or on the outside of, the attachment member 200. The anchor element 302, a portion of the main body 102 (in the recess 132), the base plate 210 of the attachment member 200, and the lock mechanism 300 are secured together by the fasteners 306. In one example, the fasteners engage with the anchor element 302 and the lock mechanism 300 to clamp the base plate 210 of the attachment member 200 and the portion of the main body 102 there between. An advantage of coupling the attachment member 200 to the luggage article 100 as an assembly with the lock mechanism 300 may be cost savings realized by using the lock mechanism 300 and the anchor element 302 to serve an additional function of securing the attachment member 200 to the luggage article 100. Additionally, joining the attachment member 200, and the lock mechanism 300 together in the assembly 322 may increase the strength and/or rigidity of the combined assembly 322. The lock mechanism 300 as received in the recess on the top of the base is better protected from damage, in part by the rim covering some of the periphery of the lock mechanism.

The recess 132 is formed in the main body 102 of the luggage article 100. The recess 132 is defined by a depression of the main body 102 into the luggage article 100. The recess 132 has a depth, length, and a width suitable to receive at least a portion of the attachment member 200. The attachment member 200 is defined by a body 202 including a base plate 210, a shank 208, an intersecting portion 206, and a tine 204. In some embodiments, the shank 208 extends at an angle from the base plate 210. In some embodiments, the intersecting portion 206 extends at an angle from the shank 208. In some embodiments, the tine 204 extends at an angle from the intersecting portion. In some embodiments, the shank 208, the intersecting portion 206, and the tine 204 transition smoothly between one another such as in one or more curves. In one example, the attachment member 200 may in part include a hook member 211. The main body 202 of the attachment member 200 may in part form the hook member 211. In one example, the hook member 211 may be formed by at least the shank 208, the intersecting portion 206, and the tine 204. In one example, such as that of FIG. 4, the hook member 211 may have a generally curved shape, such as a generally J-shaped curve. The attachment member 200 may thus include the hook member 211 and the base plate 210. In one example, such as shown in FIGS. 1 and 4, attachment member 200 curves away from the luggage article 100. For example, the hook portion 211 of the attachment member 200 may curve away from the luggage article 100, such as for example the tine 204 of hook member 211 may curve upwards and away from the top panel 112 of the luggage article 100.

The base plate 210 includes an upper surface 244 having a rim 212 extending around the upper surface 244 forming a recess. The rim 212 may vary in height in a portion thereof to form a scallop 224 to allow access to the actuator 318 when the luggage article 100 is assembled, such that a user can operate the actuator 318 to disengage the lock mechanism 300. The rim 212 and the recess in the upper surface 244 form a receptacle 246 suitable to receive the lock mechanism 300. The height of the rim 212 may be higher near the front panel 104 than near the rear panel 106 (see, e.g., FIG. 5) to stiffen and/or strengthen the front of the base plate 210 and reduce flexure of the attachment member 200 and/or stabilize the lock mechanism 300 against lateral forces. Additionally, the lower rear portion of the rim 212 may allow for better access to the pull tabs of the closure mechanism 124. As discussed above, the lock mechanism 300, the attachment member 200, and the anchor element 302 may be sandwiched together with a portion of the main body 102 in the assembly 322. On the bottom of the body 202 are, one or more apertures 216*a* that may extend through the body 202 to enable the coupling of the attachment element in the assembly 322. The apertures 216*a* may extend through the upper surface 244 such that the apertures 216*a* are in communication with the receptacle 246 at one end and the lower surface 222 at the other end. The apertures 216*a* may be operative to receive respective fasteners 306 to couple the attachment member 200 to the luggage article 100. The apertures 216*a* and 216*b* may be clearance apertures with a dimension larger than a dimension of the fastener 306.

The body 202 may be formed of any suitable material such as plastic, metal, a composite material (e.g., a fiber reinforced composite), wood, etc. The body 202 may be formed by any suitable method such as vacuum forming, injection molding, subtractive manufacturing (e.g., machining), additive manufacturing (e.g., 3D printing), or the like. The body 202 may be a single unitary piece. The body 202 may be two or more pieces joined to one another such as by a fastener, adhesive, brazing, welding, or the like.

In some embodiments, the base plate 210 has a dimension 240 between the upper surface 244 and the lower surface 222 of about 3-4 mm. In other embodiments, the dimension 240 may be about 1 mm or 2 mm. In other embodiments the dimension 240 may be about 5 mm, 6 mm, 7 mm, 8 mm, 9 mm, 10 mm, or more.

The shank 208 may extend from the base plate 210. The shank 208 may extend generally down into the recess 132 in the top panel 112 of the main body 102. The shank 208 may also extend in the recess 132 from the base plate 210 toward the front panel 104. In one embodiment, the shank 208 extends into the recess 132 at an angle from a plane defined by the top panel 112 (see, e.g., FIG. 5). In some embodiments, a securement recess 214 may be formed in the body 202 such as near an interface of the shank 208 and the intersecting portion 206. The securement recess 214 may be operative to receive a fastener to better secure the attachment member 200 to the luggage article 100. In many embodiments, the securement recess 214 is optional. The shank 208 has a width dimension 248 (see, e.g., FIG. 4). The shank 208 defines an intermediate face 220 on a lower surface thereof. In many embodiments, the intermediate face 220 is a planar surface. In other embodiments, the intermediate face 220 may be a curved or irregularly shaped surface.

The intersecting portion 206 extends from a lower end of the shank 208 opposite the upper end of the shank 208. The intersecting portion 206 is a transition portion between the shank 208 and the tine 204. In one embodiment, the intersecting portion 206 forms a surface 232 on an upper surface thereof. The surface 232 may be a planar surface. The surface 232 may be operative to receive or support an attachment of secondary luggage article such as a strap or handle to selectively attach the secondary luggage article to the primary luggage article 100. In one embodiment, the surface 232 has a length of about 4 mm in the dimension 234. In other embodiments, the length of the dimension 234 may be about 0 mm, 1 mm, 2 mm, 3 mm, 5 mm, 6 mm, 7 mm, 8 mm, 9 mm, 10 mm, or more. In other embodiments, the surface 232 may be a curved or filleted shape with no effective length in the dimension 234.

The tine 204 of the hook shape extends generally upward from the intersecting portion 206. The tine 204 may also extend back toward the rear panel 106 (see, e.g., FIG. 5). In some embodiments, the tine 204 may extend at an angle 250 of about 18° relative to a normal direction 158 of the top panel 112, and in some examples in the direction of a center of the luggage case 100, and in the example shown in the direction of the lock mechanism 300 (See FIG. 3). In some embodiments, the tine 204 may extend at an angle 250 of about 0°, 5°, 10°, 15°, 20°, 25°, 30°, 35°, 40°, 45° or more relative the normal direction 158 of the top panel 112. The tine 204 may also have a width dimension 248 (see, e.g., FIG. 2). The tine 204 has a thickness dimension 238 at a transition between the tine 204 and the intersecting portion 206. In some embodiments, the thickness dimension 238 is about 9.5 mm. In other embodiments the thickness dimension 238 may be about 5 mm, 6 mm, 7 mm, 8 mm, 9 mm, 10 mm, or more. The thickness dimension 238 may be the thickest part of the attachment member 200 such as to counteract bending forces on the tine 204 imparted by attached luggage articles or the like. The tine 204 has a thickness dimension 236 near a tip 242 thereof. In some embodiments, the thickness dimension 236 is about 7 mm. In other embodiments the thickness dimension 236 may be about 1 mm, 2 mm, 3 mm, 4 mm, 5 mm, 6 mm, 7 mm, 8 mm, 9 mm, 10 mm, or more. In some embodiments, the thickness dimension 236 may taper from a central portion of the tine 204 toward the edges of the tine 204 along the width thereof. In some embodiments, the dimension of the tine 204 tapers from the thickness dimension 238 to the thickness dimension 236. For example, the thickness dimension 236 may be less than the thickness dimension 238.

When an additional luggage case is engaged with the attachment member 200, a portion of the additional luggage case, such as a handle, is received by at least a part of the retention feature of the attachment member formed by a portion of the upper surfaces of the shank 208, a portion of the tine 204, and the intersecting portion 206.

Figure 2A:
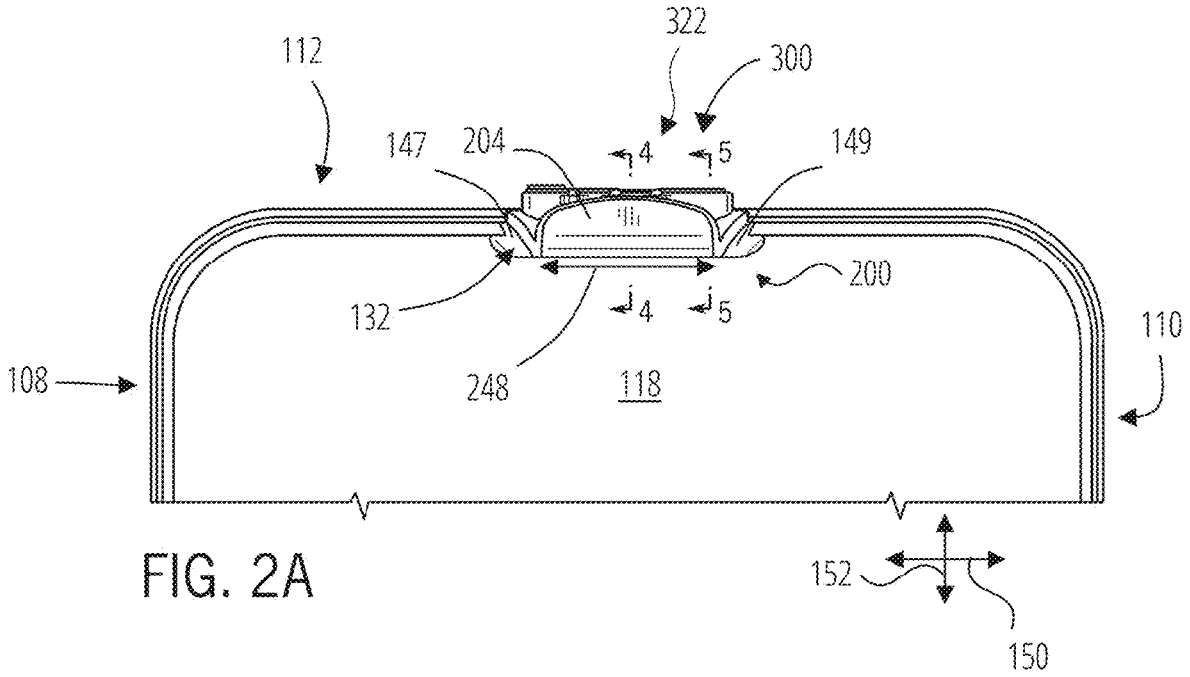
FIG. 2A is a partial front elevation view of the luggage article of FIG. 1, and shows an attachment member.

In some embodiments, the attachment member 200, such as for instance shown in FIG. 2A, has a width dimension 248 of about 70 mm. For example, at least a portion of the shank 208, the intersecting portion 206, and/or the tine 204 may have a width dimension 248 of about 70 mm. In some embodiments, the width dimension 248 of the shank 208, the intersecting portion 206, and/or the tine 204 may be about 10 mm, 20 mm, 30 mm, 40 mm, 50 mm, 60 mm, 70 mm, 80 mm, 90 mm, 100 mm, or more. The width dimension 248 may be generally consistent between the shank 208, the intersecting portion 206, and/or the tine 204.

Figure 2B:
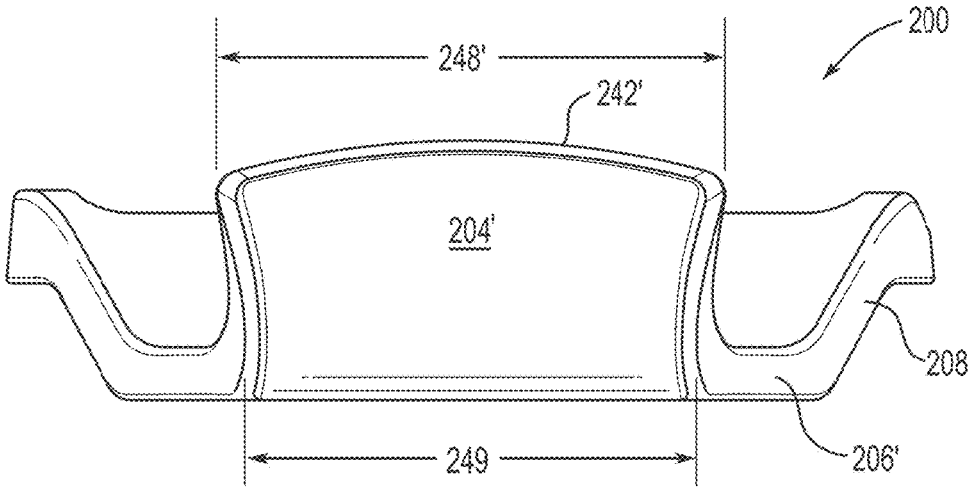
FIG. 2B is a front elevation view of another embodiment of the attachment member.

Alternatively, in another example of the attachment structure 200' as shown in FIG. 2B, the width 248' (in the same or similar width direction as width 248) of the region of the tine 204' near the tip 242' may be wider than the width 249 of the tine 204' at or near its intersection with the intersecting portion 206'. In this example the width dimension 248' of the region of the tine 204' near the tip 242', may be approximately 50 mm, with the tine 204' tapering inwardly as it extends downwardly to a width dimension 249 of approximately 47.5 mm at or near where the tine 204' engages with the intersecting portion 206'. The attachment structure 200', other than the width dimensions as described above, is structurally the same as or is identical to the attachment structure 200 referenced elsewhere herein. A benefit of a relatively wide tine, such as by relatively consistent width dimension 248 or varying width dimensions 248' and 249, may be that the attachment member is strong enough to resist deflection, torsion, deformation, or breakage and may impart less stress on articles coupled to the luggage article 100 via the attachment member relative to a narrower attachment member. Additionally, the width dimension 248 of approximately 70 mm is approximately the width of a typical human hand, which is the basis of the size of many handles on bags that might be coupled with the attachment member 200.

As best shown in FIG. 6, the main body 102 may have a recess 132 formed therein. The recess 132 may be adapted to receive the attachment member 200 and/or the lock mechanism 300. A benefit of the attachment member 200 and/or portion of the lock mechanism 300 being received in the recess 132 may be to reduce the protruding distance of the attachment member 200 above the top panel 112, which is a difficulty with respect to additional features and functionality structures attached to the exterior of hard side luggage. The attachment member 200 and the lock mechanism 300 while received in the recess 132 do not increase the external size of the luggage article 100. Additionally, by being received in the recess 132, at least partially, the attachment member 200 and the lock mechanism 300 may be somewhat protected from damage such as when snagging on, or being impacted by, objects when being handled. Positioning the attachment member 200 and/or the lock mechanism 300 in the recess 132 may result in a luggage article 100 that is more aesthetically pleasing than simply attaching the attachment member 200 and/or lock mechanism 300 to the main body 102. Positioning the attachment member 200 and/or lock mechanism 300 in the recess 132 may form a stronger assembly 322 as the walls of the recess 132 help keep the tine 204 from being displaced laterally. For example, the side walls 134*a, b* may support the attachment member 200 such that lateral or twisting displacement thereof is limited.

In many embodiments the recess 132 is formed in the lid 118. In the present example, the recess 132 is formed in the top panel of the lid 118. In other embodiments, the recess 132 may be formed in another portion of the main body 102 such as the base 120. The recess 132 is formed as an area of off-set depression. The recess may be defined by a periphery, in the current example, by sidewall 134, and a floor portion 135. The side wall 134 may extend at a right angle from the floor 135, or may extend at an angle other than a right angle from floor 135. The recess has at least one depth, at least one width (e.g. as measured between side walls 134*a* and 134*b*), and at least one length (e.g. as measured by between the front wall 142 and the rear wall 146). The recess 132 may have one or more sub-portions such that when combined together form the entire recess 132. The depth, width and length of any sub-portions of the recess may be the same or different than another sub-portion. Generally, the width of the recess 132 between walls 134*a* and 134*b*, and the length of the recess between the front wall 142 and rear wall 146 are sufficiently sized to receive the attachment member 200, as described further below. In one example, the width of the recess between side walls 134*a* and 134*b* is greater than the width of the attachment member 200. The difference in width dimensions may form a gap 147, 149 between either side of the hook member 211 and the respective side wall 134*a* and/or 134*b*. In one example, the width between the walls 134*a* and 134*b* may be about 115 mm.

In some embodiments, the recess 132 includes a first sub-portion 137 defined by upper floor 138, side walls 134*a* and 134*b*, and a rear wall 146. The upper floor 138 may be at a depth of approximately 6-7 mm. In some embodiments, the upper floor 138 extends generally in a plane oriented similarly to (such as example being parallel to) the panel in which the recess 132 is formed. One or more apertures 156*a* and 156*b* may be formed in the upper floor 138. The apertures 156*a* and 156*b* may be operative to receive one or more respective fasteners 306. The apertures 156*a* and 156*b* may be clearance apertures with a dimension larger than the respective fastener 306.

In some embodiments, the recess 132 includes a second sub-portion 139 defined by an intermediate floor 140. The intermediate floor 140 may extend from the first sub-portion to a third sub-portion. Because the third sub-portion has a greater depth than the first sub-portion, the intermediate floor may have an increase depth as it angles downwardly from the first sub-portion to the third sub-portion 141, forming a ramp between the first and second sub-portions. The intermediate floor 140 in this example may be at a depth of approximately 6-7 mm where it intersects the first sub-portion 137, and at a depth of approximately 18-19 mm where it intersects the third sub-portion. In this example, the intermediate floor 140 extends at an angle relative to the first sub-portion and the third sub-portion. As discussed further herein, the ramp or slope of the intermediate floor may support a part of the attachment member 200, such as the shank 208.

In some embodiments, a third sub-portion 141 of the recess 132 may extend towards the front panel 104, and in some examples may extend sufficiently far so as to overlap with the front panel 104. The recess may include a lower floor 136, and a front wall 142 that extends between the side wall 134*a* and the side wall 134*b* proximal to, at or overlapping the front panel 104. The lower floor 136 may be at a depth of approximately 18-19 mm. The front wall 142 may be included in a lip portion 144 of the main body 102, for example the front wall 142 may be formed by a lip portion. In some embodiments, the front wall 142 extends at an angle relative to the lower floor 136. For example, the front wall 142 may form a sloped surface that provides a smooth transition from the lower floor 136 to the panel in which the recess 132 is defined. In other embodiments, the front wall 142 may extend generally at right angles to the lower floor 136. A gap 151 may be formed between the attachment member 200 and the front wall 142. For example, the gap 151 may be formed between an end of the hook member 211 and the front wall 142. This gap may be continuous with the gaps 147, 149 on opposing sides of the attachment member 200 when in the recess 132. In one embodiment the recess 132 does not include a front wall 142, and the attachment member 200 (for example the hook member 211) may not have be enclosed at or near the front panel 104.

In some embodiments, the recess 132 includes a rear wall 146 extending between the side wall 134*a* and the side wall 134*b* opposite the front wall 142. In some embodiments, the rear wall 146 extends generally at a right angle from the adjacent upper floor 138.

As best shown in FIG. 4 and FIG. 5, in some embodiments, when the luggage article 100 is assembled, the attachment member 200 may be received in the recess 132. The lower surface 222 may be disposed on the upper floor 138. As best shown in FIG. 5 and FIG. 6, in some embodiments, the anchor element 302 may be disposed on an interior surface of the main body 102 below the upper floor 138 of the recess 132. The lock mechanism 300 may be disposed above the attachment member 200. The lock mechanism 300 may be received in the receptacle 246. One or more fasteners 306 may be inserted through the one or more respective apertures 304*a* and 304*b*. The one or more fasteners 306 may be inserted through the respective aperture 156*a* and 156*b*. The fasteners 306 may be inserted through the one or more apertures 216*a* and 216*b*. The fasteners 306 may be inserted into the one or more recesses 308. In some embodiments, the fasteners 306 may include helical threads such that when the fasteners 306 are rotated relative to the recesses 308, the respective threads of the fasteners 306 and the recesses 308 engage to secure the attachment member 200 to the luggage article 100 between the anchor element 302 and the lock mechanism 300. In other embodiments, such as when the fasteners 306 are rivets, the head of the rivet may be inserted through the apertures as described above and the rivet expanded to secure the attachment member 200 to the luggage article 100 via the lock mechanism 300 and the anchor element 302.

When installed with the luggage article 100, the lower face 218 may be disposed on the lower floor 136. In some embodiments, the lower face 218 rests on the lower floor 136 but is not coupled thereto. In some embodiments, the lower face 218 is coupled to the lower floor 136. In some embodiments, the intermediate face 220 may be disposed on the intermediate floor 140. In some embodiments, the intermediate face 220 rests on the intermediate floor 140 but is not coupled thereto. In some embodiments, the intermediate face 220 is coupled to the intermediate floor 140. In some embodiments, the shank 208 and/or the intersecting portion 206 is coupled to one or more of the lower floor 136 or the intermediate floor 140 such as with an appropriate fastener received in the securement recess 214. The tine 204 may be spaced apart from the front wall 142. A benefit of not coupling the shank 208, the intersecting portion 206, and/or the tine 204 to the main body 102 may be that the attachment member 200 forms a cantilever structure. A cantilever structure may flex such as when it becomes snagged on an object during handling. The flexure of the attachment member 200 may enable the attachment member 200 to be released from the object without breaking.

As shown in FIG. 5, a portion 103 of a second luggage article 101, such as one or more handles, may engage the attachment member 200. In some examples, the portion 103 may be seated in the attachment member 200, and may engage a portion of the shank 208, a portion of the intersecting portion 206, and/or a portion of the tine 204 in order to remain removably secured to the attachment member 200. The portion of the attachment member 200 on which the second luggage article 101 is received may have a width dimension of approximately 70 mm as noted above. This width dimension may be a suitable size because many handle structures of luggage articles adapted for carrying by hand have a grip portion of approximately 70 mm. Additionally, a width dimension of approximately 70 mm provides a sufficiently wide and stable contact for a loop handle of the second luggage case to reduce the lateral side to side movement of the second luggage article 101 suspended from the engagement member 200 as the primary luggage article 100 is pulled or moved along a support surface.

Figure 3:
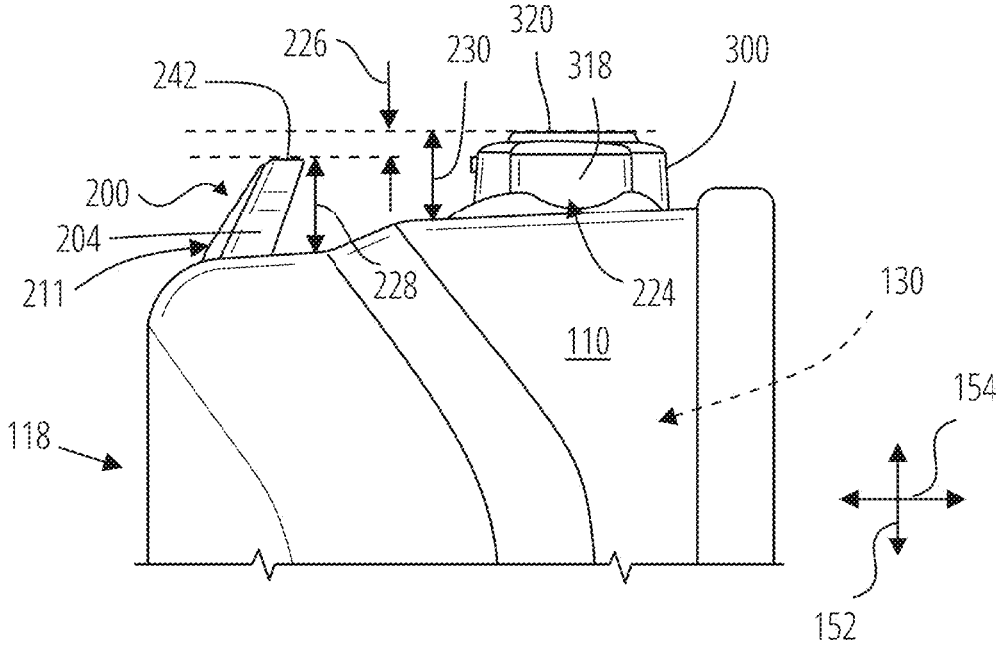
FIG. 3 is a partial right elevation view of the luggage article of FIG. 1.

As best shown in FIG. 3, when the attachment member 200 is installed with the luggage article 100, the tip 242 of the tine 204 may be disposed a relief 228 distance above the main body 102 of the luggage. For example, the tip 242 may rise above the top panel 112 by a relief 228. Similarly, the upper surface 320 of the lock mechanism 300 may be disposed a relief 230 above the main body 102. For example, the upper surface 320 may be disposed above the top panel 112 by a relief 228. The relief 228 may be less than or equal to the upper surface 320, such that the tip 242 is disposed a clearance 226 below the upper surface 320. Such an arrangement may have the benefit of reducing the likelihood of the tine 204 to snag on objects as the luggage article 100 is moved. Reducing the likelihood of snagging may enable the luggage article 100 to be moved more easily (e.g., through luggage handling systems) and may reduce the risk of breakage of the attachment member 200. The tip 242 of the tine 204 may also be disposed at or below an upper surface of the carry handle 128.

In another example, as shown in FIGS. 7 to 13C, the first luggage article may have an attachment member for releasably supporting a second article, such as a purse or bag. The luggage article may include a lock mechanism to selectively engage and, or limit movement of a closure assembly that opens and closes the luggage case. The attachment member and the lock mechanism may define an attachment assembly. The attachment assembly may be attached to a panel of the luggage case. The lock mechanism and attachment member may be stacked together when attached to the panel. The retention feature may extend over the panel, with a gap formed between at least a portion of the retention feature and the panel. The retention feature, an end of the base plate, and the panel may combine to define a supporting structure for receiving a portion of the second article, such as a handle.

The luggage article 400 of the present example may be substantially similar to the luggage article 100 previously described and may include similar components such as a front panel 404 and an opposing rear panel 406, a top panel 412 and bottom panel 414, and opposing left panel 408 and right panel 410. The luggage article 400 may include a first shell 418 and a second shell 420 hingedly connected to another. The panel 403 referenced in this example may be any of these panels, for example the right panel 410. The attachment assembly 500 may be located in a variety of positions on the luggage article 400, such as for example any location near a closure mechanism 424 when a lock mechanism 600 is included, or in any number of locations if used without a lock mechanism 600. Further, the attachment assembly 500 may also be located near a carry handle 428. In some examples, the attachment assembly 500 may be located in a recess 132 defined by the panel 403. The carry handle 428 may assist in protecting the attachment assembly 500 from damage in examples where the carry handle 428 has a greater height from the panel 403 than the attachment member 501.

Referring to FIGS. 8A, 8B, 9A, and 9B, an example of the attachment member 501 may include a base plate 505 and a retention feature 520 extending away from the base plate 505. The retention feature 520 may extend over the panel 403 of the luggage article 400, with a main gap 554 formed between at least a portion of the retention feature 520 and the panel 403. The retention feature 520 may define a supporting structure 550 for receiving a portion 402 of the second article 401, such as a handle, and securing it against the panel 403 of the luggage article 400. The retention feature 520 may include an opening feature 533 formed on a free end portion 529, which may be defined by a cam surface angled relative to the panel 403 of the luggage article 400. The cam surface may be configured to deflect the retention feature 520 away from the panel 403 to receive a portion 402 of the second article 401 and may bias back towards the panel 403 to capture the portion 402 of the second article 401 against the panel 403.

Figure 7:
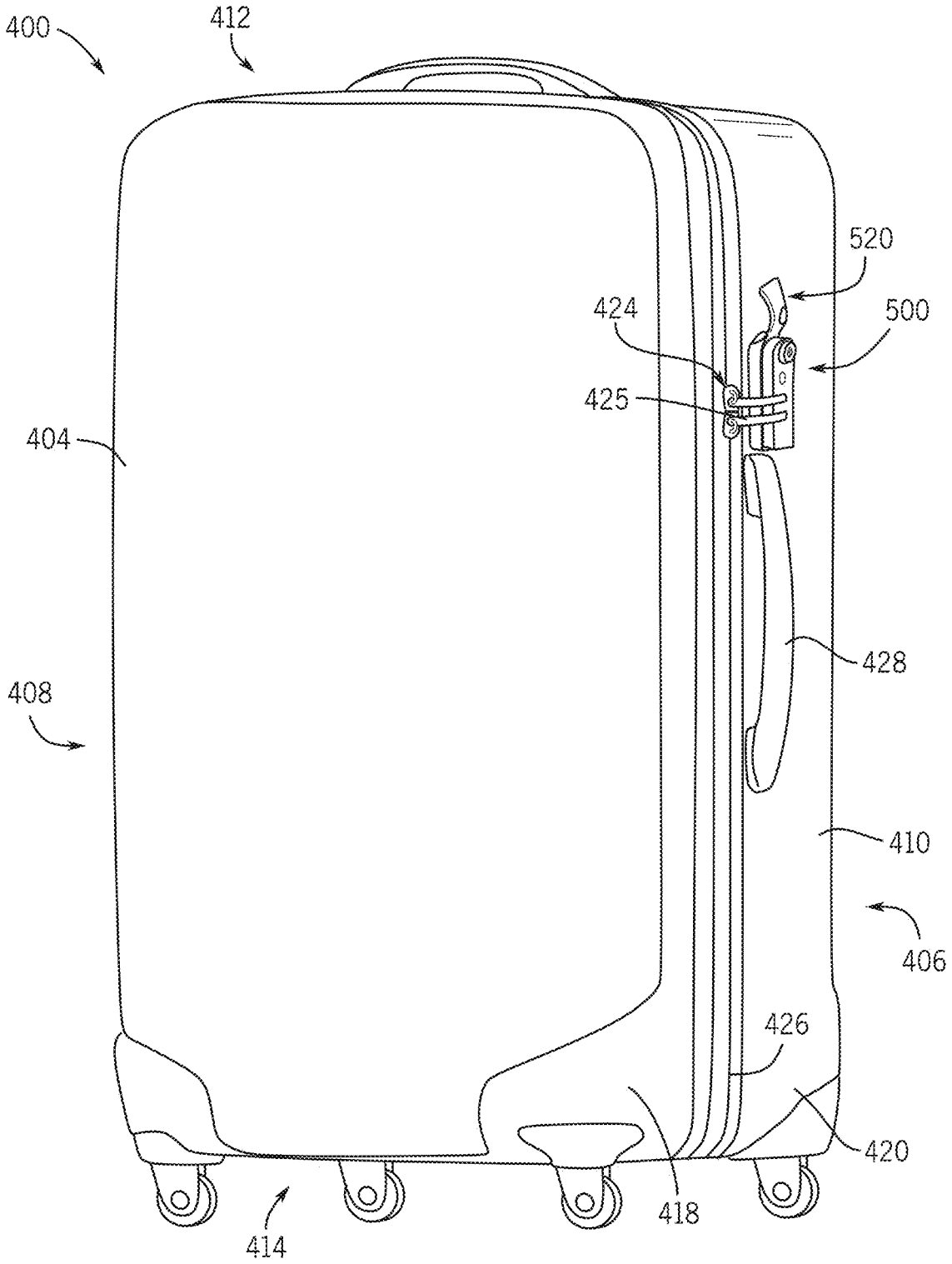
FIG. 7 is a front right isometric view of a luggage article with another example of an attachment member.

The lock mechanism 600 and the attachment member 501 may be attached to a panel 403 adjacent the closure mechanism 424, and in one example the attachment member 501 engages the panel 403, with the lock mechanism 600 positioned on top of the attachment member 501. In one example, the lock mechanism 600 and the attachment member 501 are attached to the right panel 410 as shown in FIG. 7.

Figure 8A:
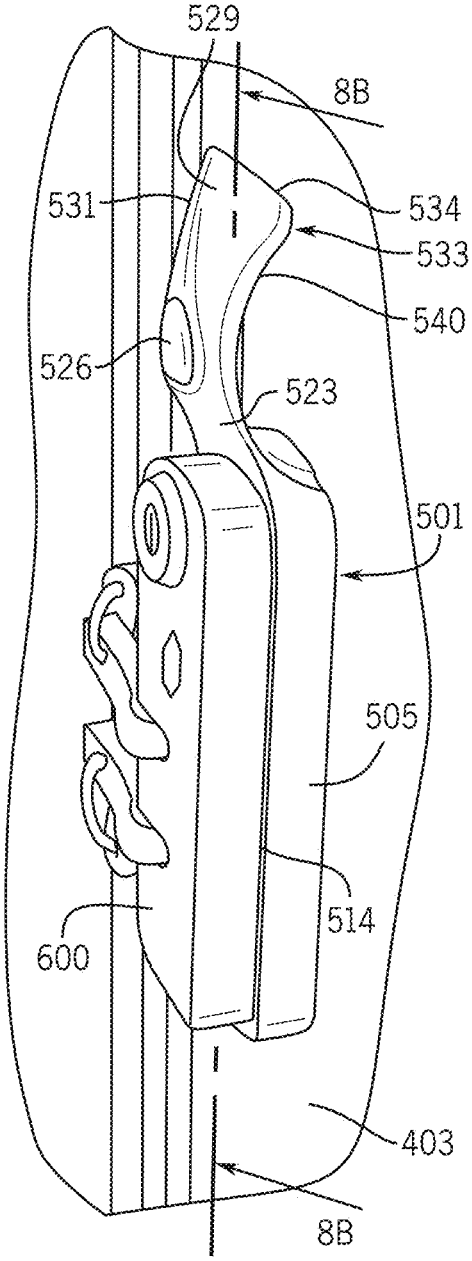
FIG. 8A shows a close up top right view of the attachment member of FIG. 7.
Figure 8B:
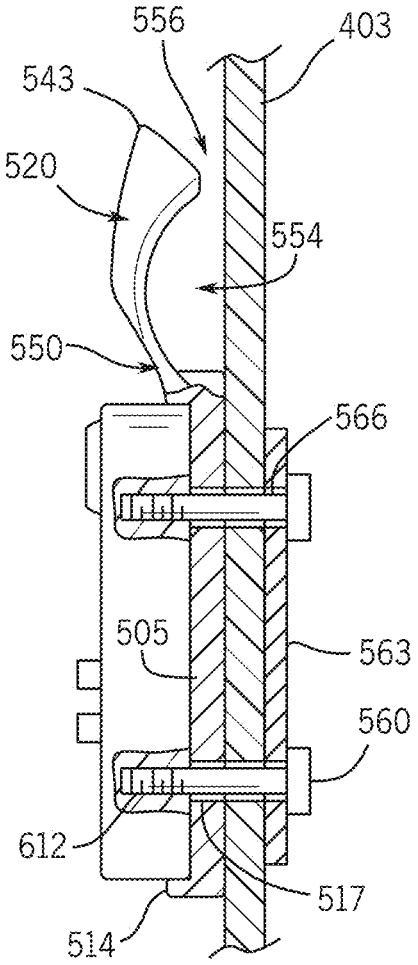
FIG. 8B shows a partial section view of the attachment member and luggage article of FIG. 8A taken along section line 8B-8B.
Figure 8C:
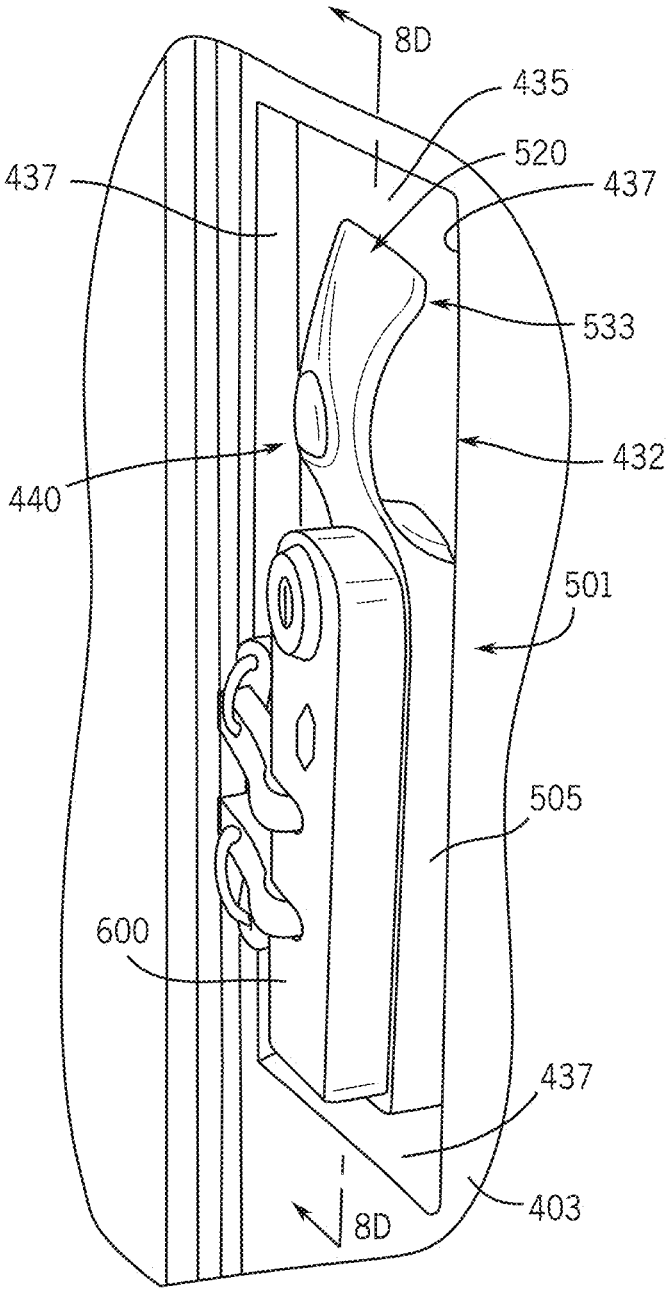
FIG. 8C shows a perspective view of the attachment member of FIG. 7 positioned in a recess of the luggage article.
Figure 8D:
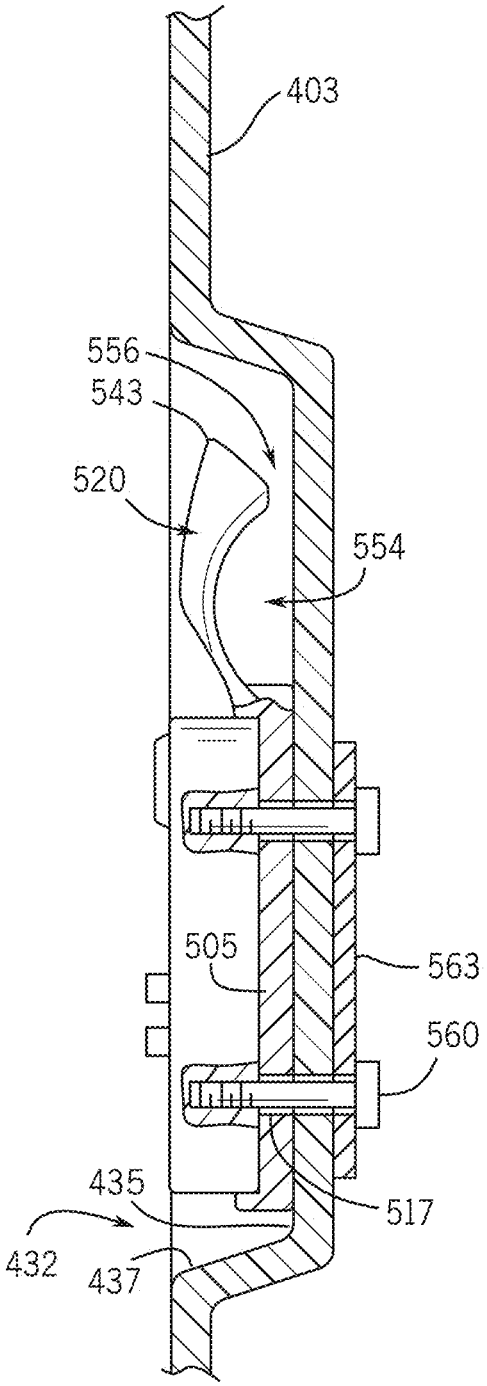
FIG. 8D shows a section taken along section line 8D-8D.

As shown in FIGS. 8A and 8B, the attachment assembly 500 may be attached to a surface of a panel 403 where the surface is generally planar or defines a three-dimensional shape protruding into or out from the surrounding portion of the panel 403. In additional examples, as shown in FIGS. 8C and 8D, the luggage article 400 may define a three-dimensional shape forming a recess or depression 432 extending below the surface of the surrounding panel 403 in which the attachment assembly 500 is received. The recess 432 may define a base wall 435 and surrounding side walls 437, the recess 432 having a sufficient depth, length, and width dimensions to receive the attachment assembly 500. For example, the recess 432 may have a size that is substantially equal to or larger than that of the attachment assembly 500. For example, the recess 432 may be at least as long as the base plate 505, wherein the retention feature 520 extends over the panel 403 outside of the recess 432 or alternatively none of or only a portion of the recess 432. In this example, the extension feature 520 extends closely along the panel 403 outside the recess 432, and may, in some examples, be in contact along all or part of its length with the panel 403. The article 401 may be clamped by the retention feature 520 by deflecting it away from the panel 403, inserting the article 401 between the retention feature 520 and the panel 403, and releasing the retention feature 520 to bias toward the panel 403 and clamp the article 401 against the panel 402.

In another example, the recess 432 may be at least as long as the base plate 505 and the retention feature 520, with the base plate 505 positioned in the recess 432 so that the retention feature 520 extends beyond the recess 432 and over the panel 403 outside the recess 432. In this example, the article 401 may be secured by the retention feature 520 by deflecting the retention feature 520 away from the panel 403 outside the recess 432, and passing the article 401 under the retention feature 520. The article 401 may be partially received in the recess 432. This example may accommodate articles 401 having a relatively larger size since the recess 432 provides a larger gap 554 between the retention feature 520 and the base wall 435 of the recess 432 than where the retention feature 520 extends closely along the panel 403 as noted immediately above.

In another example, the recess 432 may be longer than the base plate 505 and the retention feature 520, and with the base plate 505 positioned in the recess 432 so that the retention feature 520 extends over only a part of the recess 432. The portion of the recess 432 that extends beyond the retention feature 520 may provide a space extending to the end gap 556 or the main gap 554 to allow a portion 402 of the secondary article 401 to enter the recess 432. In some instances, the retention feature 520 may need to be deflected away from the recess 432 to allow the article 401 to pass into the main gap 554 and engage the retention feature 520. For example, the retention feature 520 may not define an end gap 556. In other examples, the article 401 may be positioned around the retention member 520 without deflection.

Similarly, the recess 432 may have a width dimension at least equal to that of the attachment assembly 500. In some examples, the recess 432 may have a width dimension greater than width of the attachment assembly 500. The width of the recess 432 may be sufficient to allow a portion 402 of the secondary article 401 to extend into or out of the recess 432 and between the retention feature 520 and the side walls 437 the recess 432. For example, one or more lateral gaps 440 may be defined between the side walls 437 and the retention feature 520 to allow for a portion of the article 401 to extend through. The portion 402 of the article 401 may flex or bend around the retention feature 520 and exit from the recess 432 through the lateral gaps 440.

Further, the recess 432 may have a depth sufficient to position the attachment assembly 500 below flush, flush, or above flush with the surrounding panel 403. For example, the recess 432 may be sufficiently deep so that the attachment assembly 500 is entirely received in the recess 432 and is in a below-flush position, where the top of the lock mechanism 600 may be below the surface of the panel 403 surrounding the recess 432. In other examples, the recess 432 may have a depth that the lock mechanism 600 may extend above (an above-flush position) the panel 403 surrounding the recess 432, but less than it would if it was attached to the panel 403 outside the recess 432. In a flush position, the lock mechanism 600 or another portion of the attachment assembly 500 may be at the same or substantially the same height of the surrounding panel 403. Placing the attachment assembly 500 in the recess 432 may protect the attachment assembly 500 from damage, or limit the attachment assembly 500 snagging on surrounding structures during use.

In one example, the lock mechanism 600 is positioned on top of the base plate 505 of the attachment member 501. The base plate 505 may define a recess 508 on a top surface that may receive the lock mechanism 600. The recess 508 may act to nest the lock mechanism 600 on top of the attachment member 501 when fastened to the panel 403, to stack the components. Nesting the lock mechanism 600 on top of the attachment member 501 may lower the profile of the stacked components. By lowering the profile, the assembly 500 may be less likely to be impacted by objects when being handled and less likely to sustain damage during use. The base plate 505 may have a generally elongated shape having a first longitudinal axis 511 extending along the closure mechanism 424. The base plate 505 may define one or more apertures 517. Each aperture 517 may receive a fastener 560, for attaching the lock mechanism 600 to the attachment member 501 or for coupling the lock mechanism 600 and the attachment member 501 to the panel 403 of the luggage article 400.

Continuing with FIGS. 8A and 8B, the base plate 505 may define a rim 514 extending around a perimeter of the upper surface forming the recess 508. The recess 508 may have a length, width, and depth suitable to receive a lock mechanism 600. The rim 514 may vary in height or have a uniform height relative to the rest of the base plate 505. The rim 514 may further be continuous or discontinuous around the perimeter of the base plate 505. The configuration of the rim 514 may allow access to features of the lock mechanism 600, such as the lock recesses 603 that receive the zipper pulls 425, or to a lock disengagement tab described in previous examples. The rim 514 and recess 508 may act to align the lock mechanism 600 on the base plate 505, and may also assist in retaining the lock mechanism 600 by limiting lateral movement of the lock mechanism 600.

Continuing with FIGS. 8A, 8B, 9A, and 9B, the retention feature 520 may extend outwardly from the base plate 505 and along a portion of the panel 403. The retention feature 520 may extend from, or near, the rim 514 of the base plate 505. The retention feature 520 may extend in a direction along or parallel to the first longitudinal axis 511. The retention feature 520 may include a concave-downwardly shape along its length. In one example it may be curved along its length, and in another example it may have a rectilinear shape along its length. The retention feature 520 may generally extend away from the base plate 505 and terminate in a free end portion 529. The free end portion 529 may be spaced away from the panel 403, or may be in contact with the panel 403. The shape of the retention feature 520 defines the size and shape of the gap between the retention feature 520 and the panel 403. The size of the main gap 554 between the middle portion 526 of the retention feature 520 and the panel 403 may be larger than the size of the gap between the free end portion 529 and the panel 403. In the example shown, retention feature 520 includes a first portion 523, a middle portion 526 and a free end portion 529. The first portion 523 extends up and away from the base plate 505 and the panel 403. The middle portion 526 extends from the first portion 523, such as in an upward direction and then transitions into a downward direction towards the panel 403, forming a main gap 554. The free end portion 529 extends from the middle portion 526 and continues downwardly towards the panel 403, terminating above the panel 403 to form a gap (e.g. the end gap 556) or in contact with the panel 403. As shown in FIGS. 8A and 8B, the retention feature 520 is in its first configuration, where the main gap 554 is larger than the end gap 556.

An opening feature 533 may be formed on the free end portion 529 to aid in a secondary article 401 being received in the main gap 554 defined by the retention feature 520. The opening feature 533 may be a tip edge 534 angled relative to the panel 403, such as for example a cam surface. In operation, a portion 402 of a second article 401, such as the handle 402 of an auxiliary purse article 401, may contact the tip edge 534 of the free end portion 529 to move through the end gap 556 and towards the main gap 554. The opening feature 533 may cause the retention feature 520 to flex away from the panel 403 of the luggage article 400 (to its second configuration, see FIG. 10B) to enlarge the end gap 556 to allow the portion 402 of the second article 401 to pass by the end gap 556 and into the main gap 554. The retention feature 520 may by itself define a supporting structure 550 configured to support or retain the second, or auxiliary, article on the luggage article 400. In another example, the base plate 505 (such as an end portion thereof) may combine with the retention feature 520 to define a supporting structure 550 configured to support or retain the second article 401 on the luggage article 400. When a portion 402 of the auxiliary article 401 is received in the main gap 554, the supporting structure 550 may act to retain the auxiliary article 401 within the main gap 554.

Referring now to FIGS. 9A and 9B, an end view and a top view of an example attachment assembly 500 are shown, respectively. Along the length of the retention feature 520, the width may vary from the first portion 523 to the free end portion 529. The width may be a dimension defined by opposing edges 530 of the retention feature 520 extending from the first portion 523 to the free end portion 529. The first portion 523 may have a relatively narrow width, and the middle portion 526 and at least part of the free end portion 529 may have generally increasing widths. The free end portion 529 may define a tip edge 534 having a tapering width. In some examples, the width of the first portion 523 may be less than a width of the base plate 505. The widening of the retention feature 520 from the first portion 523 to the free end portion 529 may facilitate the deflection or biasing of the retention feature 520 away from the panel 403 when receiving a second article 401. In other examples, each of the widths of the portions may be greater than, equal to, or less than each of the other widths of the other portions.

Referring still to FIGS. 9A and 9B, the retention feature 520 may also have a concave downwardly shape across its width, relative to the panel 403. For example, at least part of the retention feature 520 may have a curved shape, as shown in FIG. 9A, resulting from the opposing edges 530 extending downward towards the panel 403 relative to the rest of the retention feature 520. The curvature across the width of the retention feature 520 may form a ridge 531 along at least part of the length of the retention feature 520. For example, the ridge 531 may begin over the middle portion 526 and extend to the free end portion 529 (such as is shown in FIGS. 8A and 8B). The ridge 531 may also extend over only the free end portion 529, or in another example over the entirety of the retention feature 520. The ridge 531 may define the highest point of the retention feature 520 relative to the panel 403.

Referring still to FIGS. 9A and 9B the opening feature 533 is described. The opening feature 533 may be defined by the tip edge 534 of the free end portion 529. The tip edge 534 may form an angle relative to the panel 403, such as in one example an acute angle, or in another example an angle of approximately 45 degrees, or in another example an angle in the range of approximately 30 degrees to approximately 80 degrees. The tip edge 534 may act as a cam surface, which when engaged by a portion 402 of an auxiliary article 401, causes the retention feature 520 to flex, deflect, or be biased away from the panel 403 to allow the article 401 to pass by and be received in the main gap 554. After the auxiliary article 401 passes past the free end portion 529, the retention feature 520 then returns to its initial position (see FIGS. 10A-C and as described below). The size of the end gap 556 between the free end portion 529 and the panel 403 may make the tip edge 534 and its effective cam surface more or less effective. Where the end gap 556 is small, or non-existent, the angle of the tip edge 534 may need to be larger to create the desired deflection in the free end portion 529. In another example, where the end gap 556 is relatively large, such as approximately 4-8 mm, the tip edge 534 may have a smaller angle since the gap positions the tip end away from the panel 403.

The opposing outer edges of the retention feature 520 adjacent to the tip edge 534 may each be angled to the panel 403, and define exit edges 540. These exit edges 540 may act as a cam surface to flex, deflect, or bias the free end portion 529 away from the panel 403 when the auxiliary article 401 is removed from the main gap 554 to disengage from the retention feature 520. The retention feature 520 allows a user to removably attach articles and offload articles that would otherwise be carried by the user.

In some examples, the free end portion 529 may also be flexed, deflected, or biased away from the luggage article 400 through the application of an external force. This may be beneficial where the angle of the tip edge 534 is not sufficient to act as a cam surface, or where the portion 402 of the auxiliary article 401 is too large to engage the tip edge 534. For example, the tip edge 534 of the free end portion 529, for example where it is curved along its width such as is shown in FIG. 9A, may define a grip structure 543. The grip structure 543 may allow a user to manually bias the retention feature 520 away from the panel 403, to allow the auxiliary article to pass through the end gap 556 and enter the main gap 554 and be secured by the retention feature 520 on the luggage article 400.

Figure 10C:
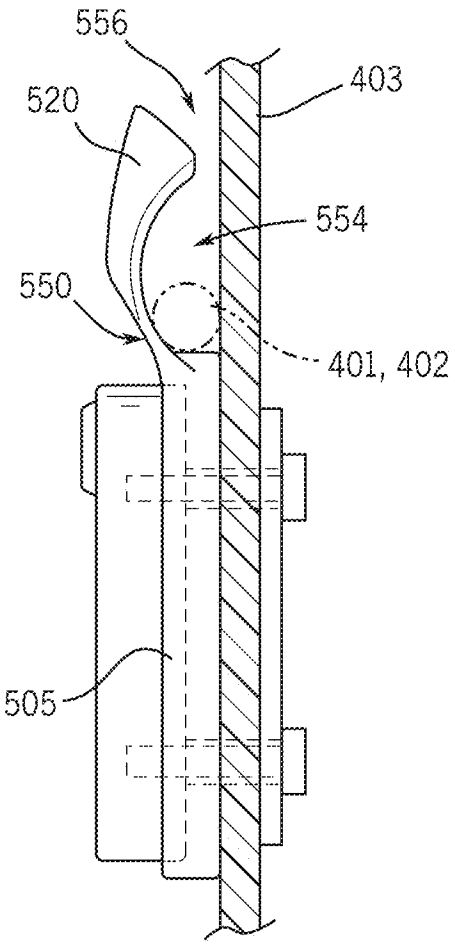
FIG. 10C shows a right elevation view of the attachment member of FIG. 7 retaining a luggage article.
Figure 10B:
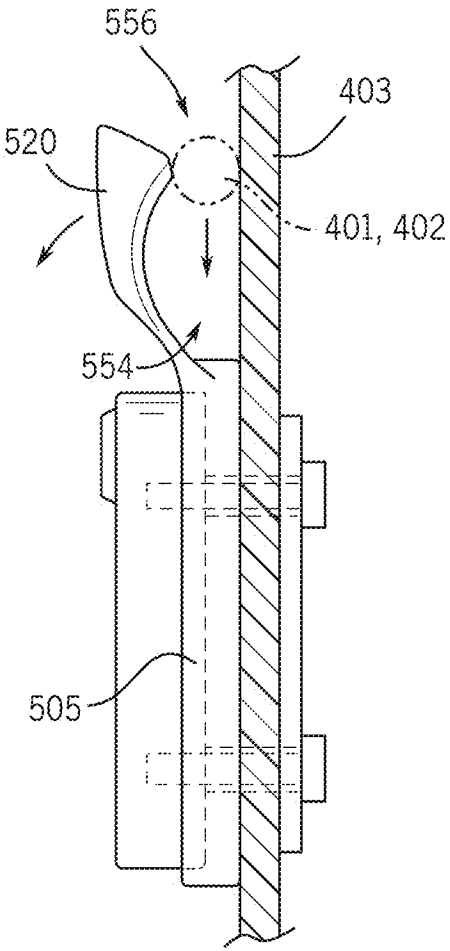
FIG. 10B shows a right elevation view of the attachment member of FIG. 7 receiving a luggage article.
Figure 10A:
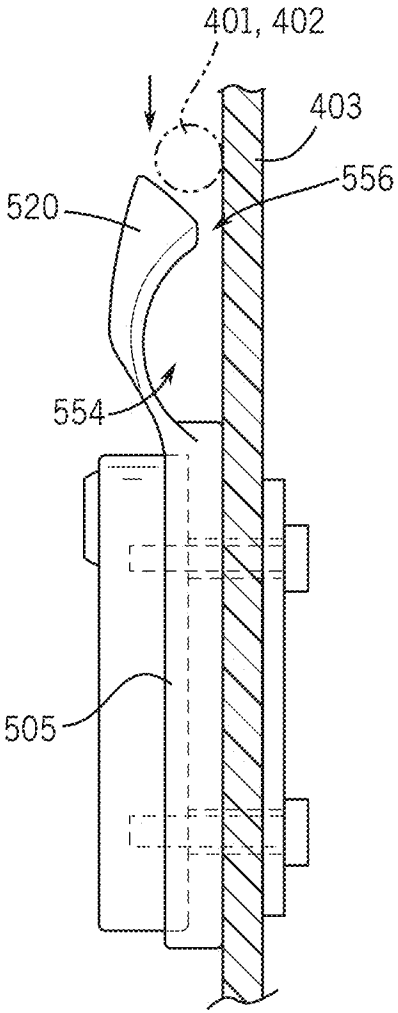
FIG. 10A shows a right elevation view of the attachment member of FIG. 7 about to receive a luggage article.

FIG. 10A to 10C may be an example attachment assembly 500 receiving, and retaining, a feature 402 of a second article 401, such as an auxiliary article, for example a handle of a purse strap, in the support structure 550. FIG. 10A shows the second article 401 approaching the opening feature 533 of the retention feature 520 while the retention feature 520 is in a first configuration. The end gap 556 between the free end portion 529 and the panel 403 is too small for the second article 401 to fit through without the end gap 556 becoming larger. The first configuration may be the resting alignment of the retention feature 520. FIG. 10B shows the second article 401 contacting the tip edge 534 of the opening feature 533, with the cam surface of the tip edge 534 causing the retention feature 520 to flex, deflect, or bias away from the panel 403 to a second configuration where the end gap 556 is sufficiently large for the second article 401 to pass into the main gap 554. FIG. 10C shows the second article 401 in the main gap 554 and retained in by the retention feature 520 in the support structure 550, with the retention feature 520 returned to its first configuration. In some examples, the second article 401 may be of a size to prohibit the retention feature 520 from returning to its initial position. In such applications, the retention feature 520 may in any event retain the second article 401 in the main gap 554, and the retention feature 520 is not returned to the first configuration, but is in a third configuration. In the third configuration, the retention feature 520 may be partially deflected by the second article 401 and in turn exert a clamping force on the second article 401 against the panel 403 to further assist in retaining the second article 401. To remove the second article 401 from the main gap 554 of the retention feature 520, the article 402 is moved toward the end gap 556 to contact the angled exit edges 540, which act as a cam surface to flex, deflect, or bias the free end portion 529 away from the panel 403 and enlarge the end gap 556 to allow the second article 401 to be removed from the retention feature 520.

The curvature across the width of the retention feature 520 may enhance the stiffness along the length of the retention feature 520. For example, where the curvature across the width is mainly in the middle portion 526 and the free end portion 529, while the first portion 523 remains relatively less curved or flat, the flex, deflection, or biasing of the free end 529 away from the panel 403 will cause the retention feature 520 to bend primarily in the first portion 523, as opposed to the relatively more stiff middle 526 and free end portions 529.

Referring to FIGS. 10A, 10B, and 10C, the lock mechanism 600 may have a generally elongated shape and may define one or more lock recesses 603. The lock mechanism 600 may include one or more apertures 612 to receive a fastener to secure the lock mechanism 600 to the attachment member 501 or the panel 403. The lock mechanism 600 may define a longitudinal axis 609, which may align with the line of connection 426 of the closure mechanism 424. The second longitudinal axis 609 may also align with the first longitudinal axis 511.

When the base plate 505 is attached to the lock mechanism 600, the plate apertures 517 and the lock apertures 612 may align to receive one or more fasteners 560 and from the inside of the luggage article 400, such. Fasteners 560 may extend from an inside region within the luggage article 400 into the lock mechanism 600. An anchor element 563, as previously described, may be positioned on an interior side of the panel 403. The anchor element 563 may define securement apertures 566 aligning with the apertures 517 of the lock mechanism 600 of the base plate 505. The securement apertures 566 may be threaded, counter sunk, or otherwise configured to receive a fastener. When fasteners 560 are used to attach the base plate 505, lock mechanism 600, and the anchor element 563 to the panel 403, the anchor element 563 may act to disperse forces and reduce stress concentrations on the luggage article 400 or a panel 403 of the luggage article 400. The anchor element 563 may also act to hide the fasteners 560 for an improved aesthetic or to prevent items inside the luggage article 400 from snagging on the fasteners 560.

Figure 11A:
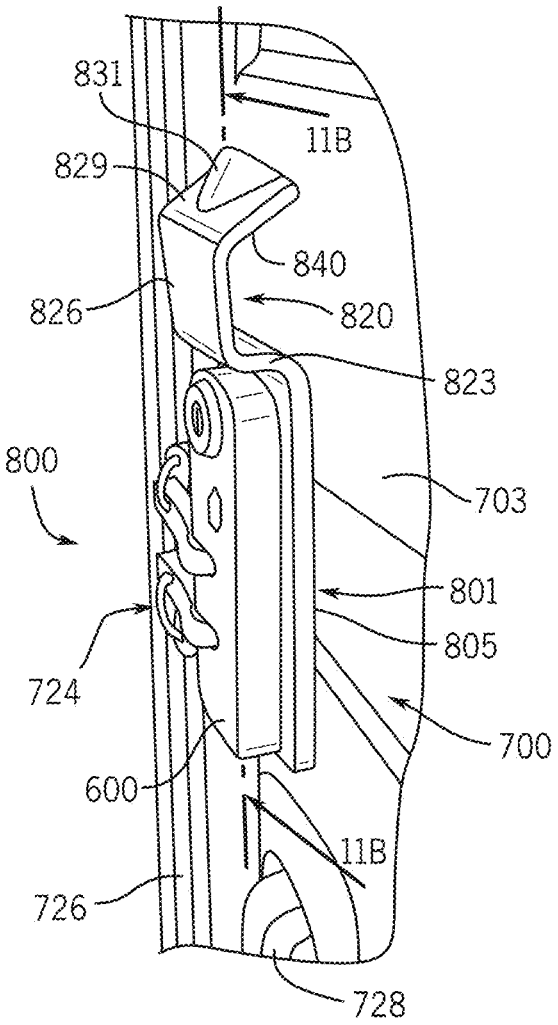
FIG. 11A shows a close up top right view of another example of an attachment member on a side panel of a luggage article.

FIGS. 11A, 11B, 11C, 11D, 12A, 12B, 13A, 13B, and 13C shows another example of the attachment assembly 800 of the present disclosure and a cross section thereof. The luggage article 700 and location of the attachment assembly 800 may be similar to the previously described luggage articles 100 and 400 and location of the assembly as previously disclosed. The luggage article 700 of the present example may be substantially similar to the luggage article 100, or 400, previously described and may include the same or similar components. The luggage article 700 may include a first shell and a second shell hingedly connected to one another. The panel 703 referenced in this example may be any of these panels. For example, as shown in FIG. 11A, the attachment assembly 800 may be attached to a right panel 710. The attachment assembly 800 may further be located adjacent the closure mechanism 724. The attachment assembly 700 may also be located in or on a feature, such as a recess 732, of the panel. In some examples, the lock mechanism 900 may be optional. When the lock mechanism 900 is not included, the attachment member 801 may be located anywhere on the luggage article 700. The attachment member 801 in this example may have the same or similar structure and function as the attachment member 801 defined above with respect to FIGS. 7 to 10C, unless otherwise described or implied.

The attachment member 801 may include a base plate 805 and a retention feature 820 extending outwardly from the base plate 805. The attachment member 801 and lock mechanism 900 may be attached to a panel 703 such that the attachment member 801 is between the lock mechanism 900 and the panel 703. By stacking the lock mechanism 900 and the attachment member 801, the effective profile of the assembly 800 may be reduced. As previously disclosed, the reduced profile may reduce the likelihood and severity of damage to the assembly 800 during use.

Figure 11B:
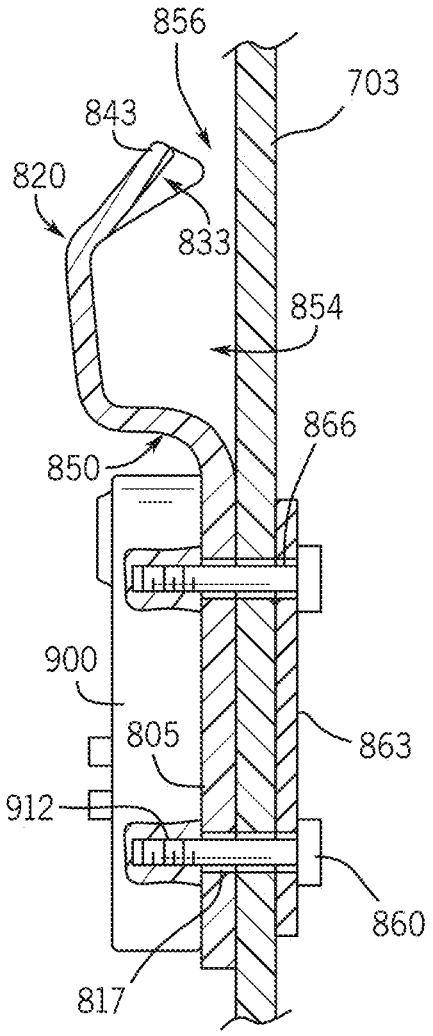
FIG. 11B shows a partial section view of the attachment member and luggage article of FIG. 11A taken along section line 11B-11B.
Figure 11C:
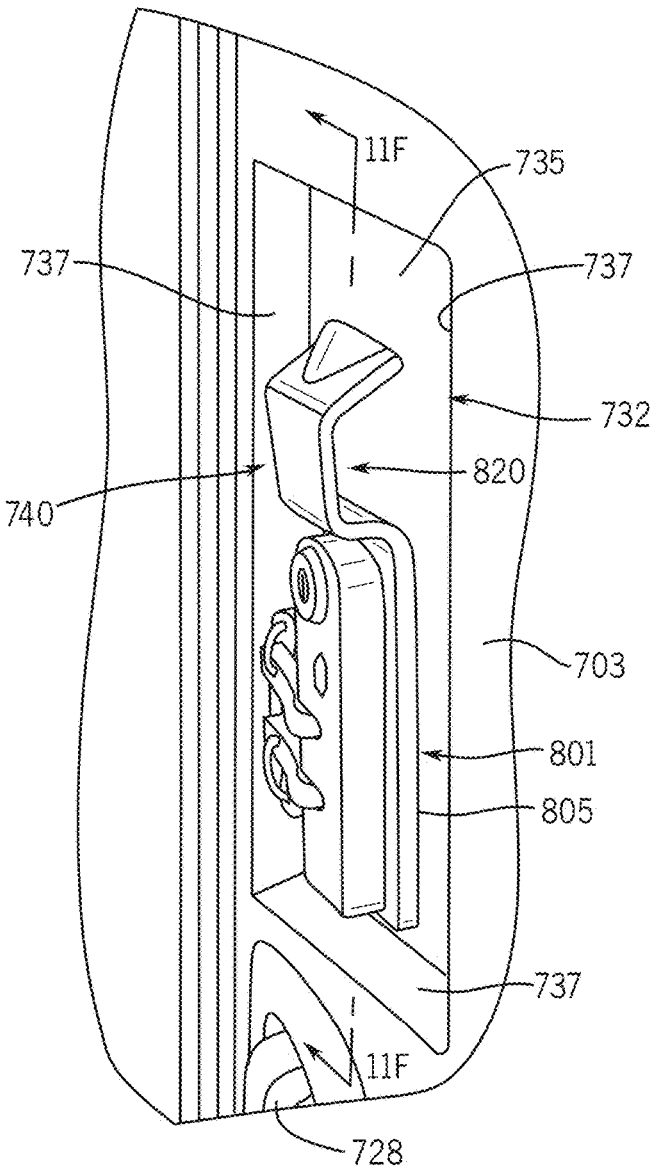
FIG. 11C shows a perspective view of the example of the attachment member of FIG. 11A positioned in a recess.
Figure 11D:
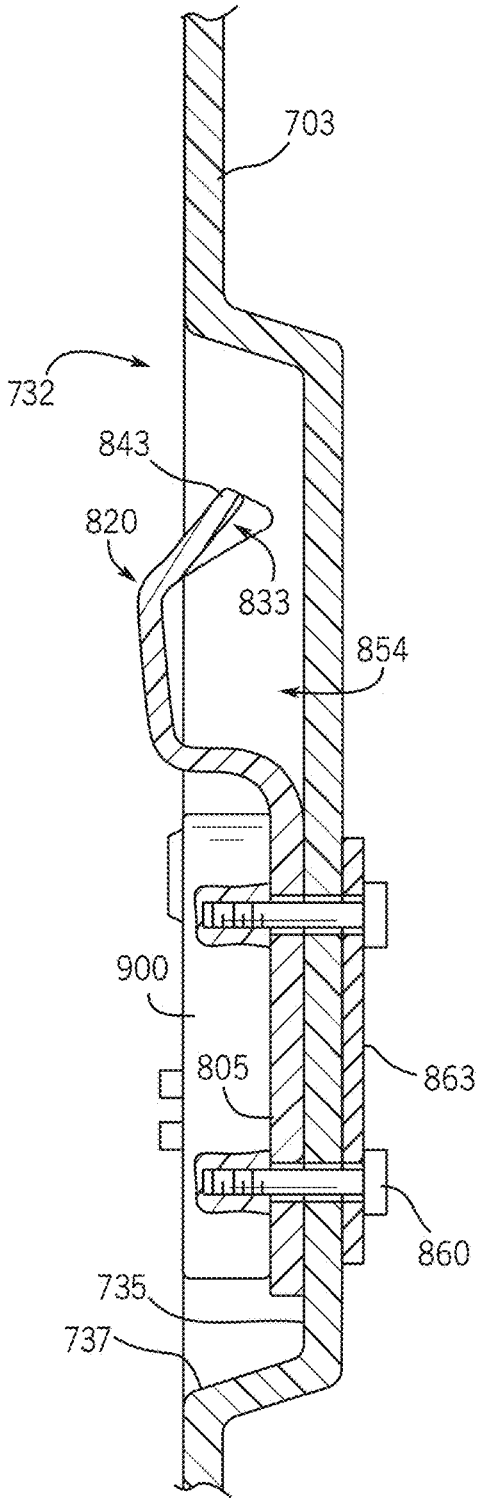
FIG. 11D shows a section view taken along section line 11D-11D.

As shown in FIGS. 11A and 11B, the attachment assembly 800 may be attached to a surface of a panel 703 where the surface is generally planar or defines a three-dimensional shape protruding into or out from the surrounding portion of the panel 703. In additional examples, as shown in FIGS. 11C and 11D, the luggage article 700 may define a three-dimensional shape forming a recess or depression 732 extending below the surface of the surrounding panel 703 in which the attachment assembly 800 is received. The recess 732 may define a base wall 735 and surrounding side walls 737, the recess 732 having a sufficient depth, length, and width dimensions to receive the attachment assembly 800. For example, the recess 732 may have a size that is substantially equal to or larger than that of the attachment assembly 800. For example, the recess 732 may be at least as long as the base plate 805, wherein the retention feature 820 extends over the panel 703 outside of the recess 732 or alternatively none of or only a portion of the recess 732. In this example, the extension feature 820 extends closely along the panel 703 outside the recess 732, and may, in some examples, be in contact along all or part of its length with the panel 703. The article 701 may be clamped by the retention feature 820 by deflecting it away from the panel 703, inserting the article 701 between the retention feature 820 and the panel 703, and releasing the retention feature 820 to bias toward the panel 703 and clamp the article 701 against the panel 702.

In another example, the recess 732 may be at least as long as the base plate 805 and the retention feature 820, with the base plate 805 positioned in the recess 732 so that the retention feature 820 extends beyond the recess 732 and over the panel 703 outside the recess 732. In this example, the article 701 may be secured by the retention feature 820 by deflecting the retention feature 820 away from the panel 703 outside the recess 732, and passing the article 701 under the retention feature 820. The article 701 may be partially received in the recess 732. This example may accommodate articles 701 having a relatively larger size since the recess 732 provides a larger gap 854 between the retention feature 820 and the base wall 835 of the recess 732 than where the retention feature 820 extends closely along the panel 703 as noted immediately above.

In another example, the recess 732 may be longer than the base plate 805 and the retention feature 820, and with the base plate 805 positioned in the recess 732 so that the retention feature 820 extends over only a part of the recess 732. The portion of the recess 732 that extends beyond the retention feature 820 may provide a space extending to the end gap 856, or the main gap 854, to allow a portion 702 of the secondary article 701 to enter the recess 732. In some instances, the retention feature 820 may need to be deflected away from the recess 732 to allow the article 701 to pass into the main gap 854 and engage the retention feature 820. For example, the retention feature 820 may not define an end gap 556. In other examples, the article 701 may be positioned around the retention member 820 without deflection.

Similarly, the recess 732 may have a width dimension at least equal to that of the attachment assembly 800. In some examples, the recess 732 may have a width dimension greater than width of the attachment assembly 800. The width of the recess 732 may be sufficient to allow a portion 702 of the secondary article 701 to extend into or out of the recess 732 and between the retention feature 820 and the side walls 737 the recess 732. For example, one or more lateral gaps 740 may be defined between the side walls 737 and the retention feature 820 to allow for a portion of the article 701 to extend through. The portion 702 of the article 701 may flex or bend around the retention feature 720 and exit from the recess 732 through the lateral gaps 740.

Further, the recess 7432 may have a depth sufficient to position the attachment assembly 800 below flush, flush, or above flush with the surrounding panel 703. For example, the recess 732 may be sufficiently deep so that the attachment assembly 800 is entirely received in the recess 732 and is in a below-flush position, where the top of the lock mechanism 900 may be below the surface of the panel 703 surrounding the recess 732. In other examples, the recess 732 may have a depth that the lock mechanism 900 may extend above (an above-flush position) the panel 703 surrounding the recess 732, but less than it would if it was attached to the panel 703 outside the recess 732. In a flush position, the lock mechanism 900 or another portion of the attachment assembly 800 may be at the same or substantially the same height of the surrounding panel 703. Placing the attachment assembly 800 in the recess 732 may protect the attachment assembly 800 from damage, or limit the attachment assembly 800 snagging on surrounding structures during use.

The base plate 805 may have a generally elongated shape. In one example, the base plate 805 may have a generally rectangular shape. In other examples, the base plate 805 may be a variety of shapes, such as ovular or irregularly shaped. The base plate 805 may further define a first longitudinal axis 811. In one example, the first longitudinal axis 811 may extend along the closure mechanism 724. The first longitudinal axis 811 may be parallel to or not parallel to the closure mechanism 724. The base plate 805 may also define a lower surface and an upper surface 807 opposing the lower surface. The lower surface may be arranged to engage the panel 703 of the luggage article 700. The base plate 805 may further define one or more apertures 817. Each aperture 817 may receive a fastener 860 for attaching the lock mechanism 900 to the attachment member 801, or for coupling the lock mechanism 900 and the attachment member 801 to a luggage article 700. Additionally, an anchor element 863 may be included on an interior side of the luggage article 700 to assist in attaching the attachment assembly 800 to the panel 703. The anchor element 863 may include apertures 866 aligning with the base plate 805 and configured to receive fasteners 860.

As shown in FIG. 11A-12B, the top surface 807 of the base plate 805 may be featureless or smooth. A featureless or smooth appearance may act to increase the aesthetic appeal of the attachment member 801. In one example, the top surface 807 may align with a bottom surface of the lock mechanism 900. In additional examples, the base plate 805 may alternatively include a rim similar to the rim 514 previously discussed, or other features to retain or align the lock mechanism 900 on the base plate 805.

FIGS. 11A, 11B, the retention feature 820 may extend outwardly from the base plate 805 and along a portion of the panel 703. The retention feature 820 may extend in a direction along or parallel to the first longitudinal axis 811. The retention feature 820 may include a concave-downwardly shape along its length, e.g. as shown in FIG. 11B. In this example the retention feature 820 may have a rectilinear shape along its length. The retention feature 820 may generally extend away from the base plate 805 and terminate in a free end portion 829. The free end portion 829 may be spaced away from the panel 703, defining an end gap 856, or may be in contact with the panel 703. The shape of the retention feature 820 defines the size and shape of the main gap 854 between the retention feature 820 and the panel 703. The size of the main gap 854 between the middle portion 826 of the retention feature 820 and the panel 703 may be larger than the size of the end gap 856 between the free end portion 829 and the panel 703. In the example shown, retention feature 820 includes a first portion 823, a middle portion 826 and a free end portion 829. The first portion 823 extends up and away from the base plate 805 and the panel 703. The middle portion 826 extends from the first portion 823, at least in part, in a slight upward direction away from the panel 703, forming a main gap 854. The free end portion 829 extends from the middle portion 826 and continues downwardly towards the panel 703, terminating above the panel 703 to form an end gap 856 or may be in contact with the panel 703 (e.g. the end gap 856). As shown in FIGS. 11A and 11B, the retention feature 820 in its first configuration, where the main gap 854 is larger than the end gap 856.

An opening feature 833 may be formed on the free end portion 829 to aid in a secondary article 701 being received in the retention feature 820. The opening feature 833 may be a tip edge 834 angled relative to the panel 703, such as for example a cam surface. In operation, a portion 702 of a second article 701, such as the handle 702 of an auxiliary purse article 701, may contact the tip edge 834 of the free end portion 829 to move towards the main gap 854. The opening feature 833 may cause the retention feature 820 to flex away from the panel 703 of the luggage article 700 to allow the portion 702 of the second article 701 to pass by the free end portion 829, through the end gap 856 and into the main gap 854. The retention feature 820 may by itself define a supporting structure 850 configured to support or retain an auxiliary article on the luggage article 700. In another example, the base plate 805 (such as an end portion thereof) may combine with the retention feature 820 to define a supporting structure 850 configured to support or retain the auxiliary article on the luggage article 700. When a portion 702 of the auxiliary article 701 is received in the main gap 854, the supporting structure 850 may act to retain the auxiliary article 701 within the main gap 854.

Figure 12A:
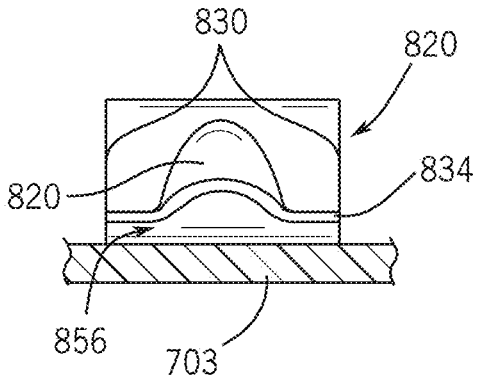
FIG. 12A shows an end elevation view of the attachment member of FIG. 11A.
Figure 12B:
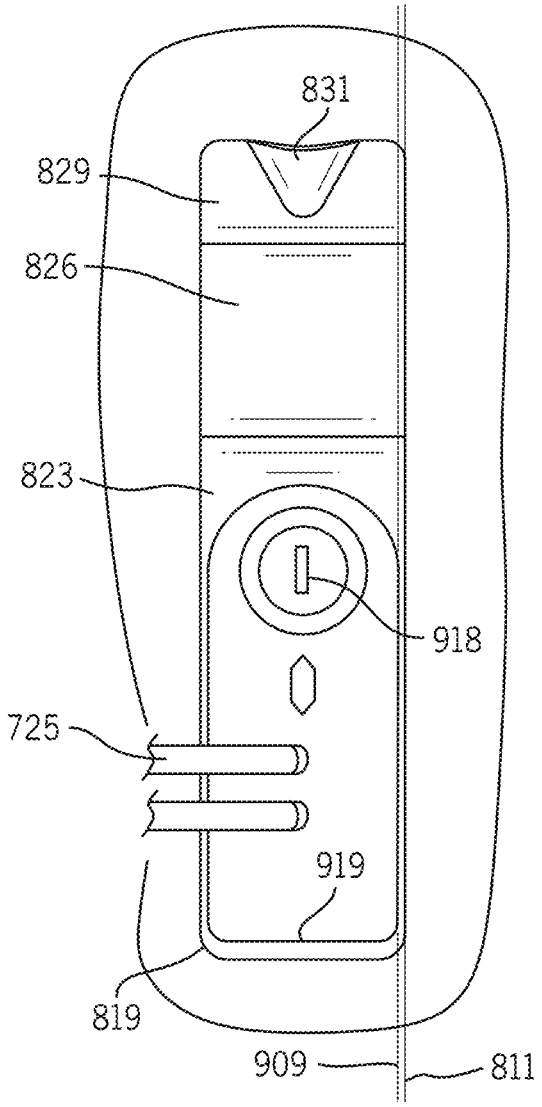
FIG. 12B shows a top plan view of the attachment member of FIG. 11A.

Referring now to FIGS. 12A and 12B, a front view and top view, respectively, of the retention feature 820 are shown. In some examples, a width of the retention feature 820 is defined by opposing edges 830. The width of the first portion 823, middle portion 826 and free end portion 829 may, in one example, be similar. In other examples, each of the width dimensions may be greater than, less than, or equal to one or more of each other width dimension. In examples where the first, middle, and end width dimensions are similar, the deflection or biasing of the retention feature 820 may be concentrated in locations where the retention feature 820 changes directions, such as at the transitions between the portions.

The retention feature 820 may also define a ridge 831 along at least a portion of the length of the retention feature 820. In one example the ridge 831 may defined in the free end portion 829 and extend to the tip edge. As shown in FIG. 12A, the ridge 831 may have a concave shape and decrease in width and height as it extends towards the middle portion 826 from the tip edge 834.

The ridge 831 may define an opening feature 833. The opening feature 833 may be a grip structure 843. The grip structure 843 may be configured to receive a force from an external source, such as a finger 1000 of a user, to assist in biasing the retention feature 820 away from the panel 703 to receive an auxiliary article. Biasing or deflecting the retention feature 820 away from the panel 703 may increase the size of the end gap 856 to allow the auxiliary article to pass through the end gap 856 and into the main gap 854.

Figure 13C:
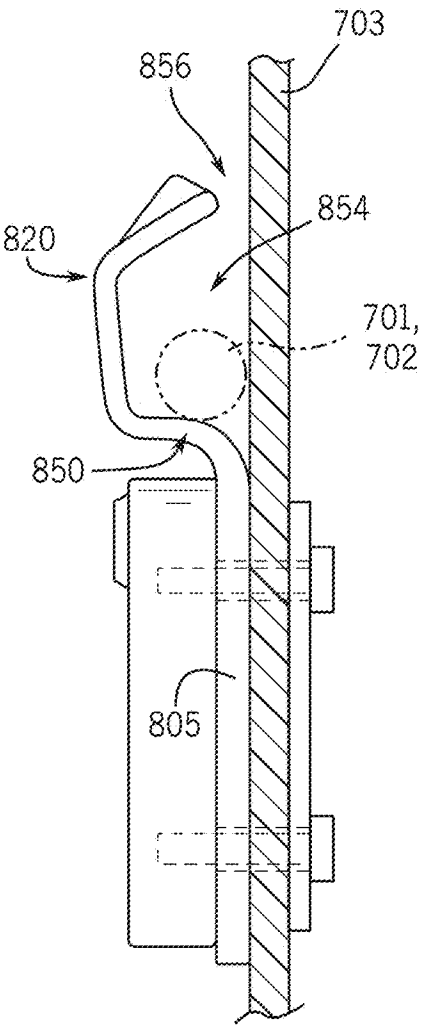
FIG. 13C shows a right elevation view of the attachment member of FIG. 11A retaining a luggage article.
Figure 13B:
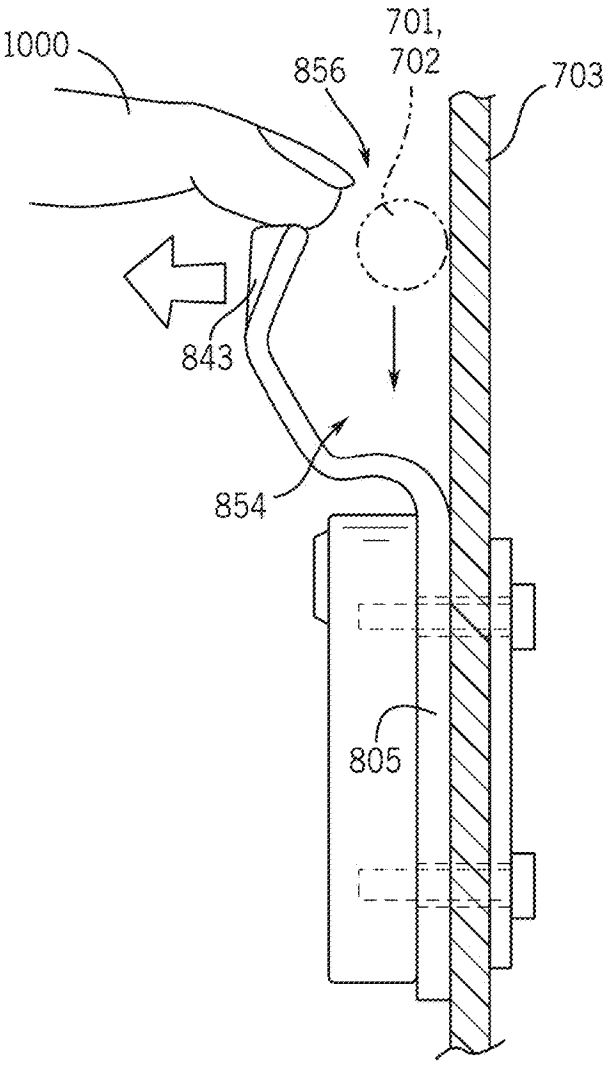
FIG. 13B shows a right elevation view of the attachment member of FIG. 11A receiving a luggage article.
Figure 13A:
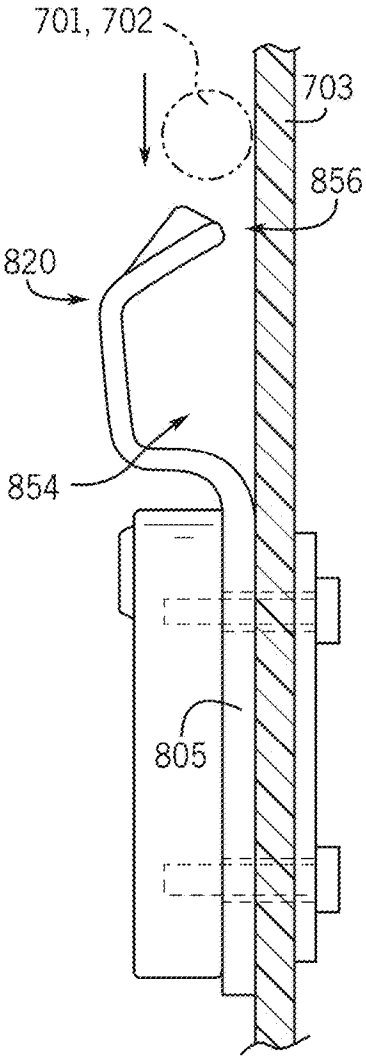
FIG. 13A shows a right elevation view of the attachment member of FIG. 11A about to receive a luggage article.

FIG. 13A-13C shows the retention feature 820 of this example receiving, and retaining, a portion 702 of an auxiliary article 701, such as a handle of a purse strap to be retained in the support structure. FIG. 13A shows the second article 701 approaching the opening feature 833 of the retention feature 820 while the retention feature 820 is in the first configuration. The end gap 856 between the free end portion 829 and the panel 703 is too small for the second article 701 to fit through without the end gap 856 becoming larger. The first configuration may be the resting alignment of the retention feature 820. FIG. 13B shows the tip edge 834 of the opening feature 833 being manually biased, deflected, or flexed upwardly away from the panel 703 to the second configuration where the end gap 856 is sufficiently large for the second article 701 to pass into the main gap 854. Alternatively, the portion 702 of the auxiliary article 701 may come into contact with the cam surface of the tip edge 834 causing the retention feature 820 to flex, deflect, or bias upwardly away from the panel 703 (such as is shown in FIG. 13B). FIG. 13C shows the second article 701 in the main gap 854 of the retention feature 820 of the support structure 850, with the retention feature 820 returned to its first configuration. In some examples, the second article 701 may be of a size to prohibit the retention feature 820 from returning to its initial position. In such applications, the retention feature 820 may in any event retain the second article 701 in the main gap 854, and the retention feature 820 is not returned to the first configuration, but is in a third configuration. In the third configuration, the retention feature 820 may be partially deflected by the second article 701 and in turn exert a clamping force on the second article 701 against the panel 703 to further assist in retaining the second article 701. To remove the second article 701 from the main gap 854 of the retention feature 820, the article is moved toward the end gap 856 to contact the angled exit edges 840, which act as a cam surface to flex, deflect, or bias the free end portion 829 away from the panel 703 and enlarge the end gap 856 to allow the second article 701 to be removed from the retention feature 820.

The lock mechanism 900 in this example may have the same or similar structure and/or function as the lock mechanism 900 described with respect to FIGS. 7-10C. For example, the lock mechanism 900 may have a generally elongated shape. The lock mechanism 900 may define a second longitudinal axis 809 aligned with the line of connection 726 of the closure mechanism 724 and may define one or more lock recesses 903. Further, the perimeter of the base plate 805 may define a first peripheral edge 819 and the perimeter of the lock mechanism 900 may define a second peripheral edge 919. When the lock mechanism 900 is attached to the base plate 805 the second peripheral edge 919 may be spaced inward from the first peripheral edge 819. The spacing may create a pyramidal shape and an effectively reduced profile for the attachment assembly 800.

The attachment members 501, 801 as described may be formed of any suitable material such as plastic, metal, a composite material (e.g., a fiber reinforced composite), wood, etc. The attachment member 501, 801 may be formed by any suitable method such as vacuum forming, injection molding, subtractive manufacturing (e.g., machining), additive manufacturing (e.g., 3D printing), or the like. The attachment member 501, 801 may be a single unitary piece. The attachment member 501, 801 may also be two or more pieces joined to one another such as by a fastener, adhesive, brazing, welding, or the like. In some examples, it may be beneficial to utilize an elastic or easily deformable material to allow the retention feature 520, 820 to deflect more easily. In other examples, a more rigid retention feature 520, 820 may be beneficial to more securely retain the auxiliary article 401, 701. The retention feature 520, 820, and other portions of the attachment assembly 500, 800 may further be coated or covered with an additional material, such as a rubber. For example, the additional material may be softer or compressible to limit damage to the retention feature or an auxiliary article 401, 701 when it is inserted or retained by the attachment assembly 800. In other examples, the additional material may be selected to assist in limiting movement of the auxiliary article 401, 701 or for providing additional grip to a user when biasing the retention feature 520, 820.

The lock mechanism 600, 900 may be operable, to thwart, prevent, or discourage the unauthorized opening of the first luggage article 400, 700. For example, the lock mechanism 600, 900 may be a zipper lock and define lock recesses 603, 903 configured to receive pull tab actuators 425, 725 of the closure mechanism 424, 724, such as a zipper. The pull tab actuators 425, 725 may be securely received in the lock recesses 603, 903. The lock mechanism 600, 900 may further include a key 618, 918 or combination lock to allow a user to selectively remove or retain the pull tab actuators 425, 725. In some examples, such as those shown in the figures, the lock mechanism 600, 900 may be only include a single type of lock to limit the total size of the lock mechanism 600, 900. The lock mechanism 600, 900 may also define one or more fastener apertures 612, 912 on a side configured to be placed on the base plate 505, 805 of the attachment member 501, 801. The apertures 612, 912 may align with the apertures of the base plate 517, 817.

The description of certain embodiments included herein is merely exemplary in nature and is in no way intended to limit the scope of the disclosure or its applications or uses. In the included detailed description of embodiments of the present systems and methods, reference is made to the accompanying drawings which form a part hereof, and which are shown by way of illustration specific to embodiments in which the described systems and methods may be practiced. These embodiments are described in sufficient detail to enable those skilled in the art to practice presently disclosed systems and methods, and it is to be understood that other embodiments may be utilized, and that structural and logical changes may be made without departing from the spirit and scope of the disclosure. Moreover, for the purpose of clarity, detailed descriptions of certain features will not be discussed when they would be apparent to those with skill in the art so as not to obscure the description of embodiments of the disclosure. The included detailed description is therefore not to be taken in a limiting sense, and the scope of the disclosure is defined only by the appended claims.

From the foregoing it will be appreciated that, although specific embodiments of the invention have been described herein for purposes of illustration, various modifications may be made without deviating from the spirit and scope of the invention. The main body 102 of the luggage article may include one or more layers of material used in the manufacture of hard sided luggage articles. Reference herein to attaching or coupling to the interior or exterior surfaces of the lid 118 and/or base 120 includes attaching or coupling to the any one, or more than one, of the one or more layers of hard sided material forming the main body.

The particulars shown herein are by way of example and for purposes of illustrative discussion of the preferred embodiments of the present invention only and are presented in the cause of providing what is believed to be the most useful and readily understood description of the principles and conceptual aspects of various embodiments of the invention. In this regard, no attempt is made to show structural details of the invention in more detail than is necessary for the fundamental understanding of the invention, the description taken with the drawings and/or examples making apparent to those skilled in the art how the several forms of the invention may be embodied in practice.

As used herein and unless otherwise indicated, the terms "a" and "an" are taken to mean "one", "at least one" or "one or more". Unless otherwise required by context, singular terms used herein shall include pluralities and plural terms shall include the singular.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "above," and "below" and words of similar import, when used in this application, shall refer to this application as a whole and not to any particular portions of the application.

Of course, it is to be appreciated that any one of the examples, embodiments or processes described herein may be combined with one or more other examples, embodiments and/or processes or be separated and/or performed amongst separate devices or device portions in accordance with the present systems, devices and methods.

Finally, the above discussion is intended to be merely illustrative of the present system and should not be construed as limiting the appended claims to any particular embodiment or group of embodiments. Thus, while the present system has been described in particular detail with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

What is claimed is:

1. A luggage article having an attachment member for releasably supporting a second article, the luggage article comprising:

a first shell and a second shell selectively secured together along a line of connection by a closure mechanism;

a lock mechanism to selectively engage and disengage the closure mechanism;

an attachment member including a base plate and a retention feature extending away from the base plate;

the attachment member attached together with the lock mechanism to a panel of one of the first or second shells;

a gap formed between at least a portion of the retention feature and the panel; and wherein the retention feature is deflected away from and biased back towards the panel to capture the second article.

2. The luggage article of claim 1, wherein the base plate is positioned between the lock mechanism and the panel.

3. The luggage article of claim 1, wherein:

the lock mechanism has an elongated shape defining a first longitudinal axis;

the attachment member has an elongated shape defining a second longitudinal axis; and the lock mechanism and attachment member are oriented with the respective first and second axes extending along a length of the line of connection.

4. The luggage article of claim 3, wherein the lock mechanism and attachment member are mounted near the line of connection.

5. The luggage article of claim 1, wherein the retention feature includes a free end directed downwardly toward the panel.

6. The luggage article of claim 5, wherein the free end is spaced away from the panel.

7. The luggage article of claim 5, wherein the free end contacts the panel.

8. The luggage article of claim 1, wherein the free end defines an opening feature.

9. The luggage article of claim 8, wherein the opening feature defines a cam surface to deflect the retention feature away from the panel as the second article is captured by the retention feature.

10. The luggage article of claim 1, wherein the gap is greatest at a middle portion of the length of the retention feature.

11. The luggage article of claim 1, wherein the retention feature has a concave shape facing the panel.

12. The luggage article of claim 11, wherein the retention feature defines a rectilinear shape.

13. The luggage article of claim 8, wherein the opening feature includes a ridge formed along a length of the retention feature.

14. The luggage article of claim 2, wherein:

the base plate defines a recess and;

the lock mechanism is received at least partially in the recess.

15. The luggage article of claim 1, wherein:

the recess is defined by a rim, and the retention feature extends from the rim.

16. The luggage article of claim 2, wherein:

the base plate defines a first peripheral edge;

the lock mechanism defines a second peripheral edge; and wherein the second peripheral edge is spaced within the first peripheral edge.

17. The luggage article of claim 1, wherein:

the panel defines a recess; and the attachment member and the lock mechanism are attached to the panel within the recess.

18. The luggage article of claim 17, wherein the retention feature extends over the recess.

19. The luggage article of claim 18, wherein the recess extends past the end of the retention feature.

20. The luggage article of claim 18, wherein the retention feature extends from the recess over a portion of the panel adjacent the recess.

* * * * *